United States Patent [19]

Rizk

[11] Patent Number: 4,545,159

[45] Date of Patent: Oct. 8, 1985

[54] MODULAR BUILDING SYSTEM AND BUILDING MODULES THEREFOR

[75] Inventor: Jihad F. Rizk, Beirut, Lebanon

[73] Assignee: Polyfab S.A.R.L., Beirut, Lebanon

[21] Appl. No.: 504,326

[22] Filed: Jun. 14, 1983

[51] Int. Cl.[4] ..... E04H 1/00

[52] U.S. Cl. ..... 52/79.9; 52/143

[58] Field of Search ..... 52/79.9, 408, 410, 412, 52/263, 143, 745, 334, 336, 79.1, 235, 302, 303, 601, 602; 59/90, 93, 96

[56] References Cited

U.S. PATENT DOCUMENTS

| | | | |
|---|---|---|---|
| 1,850,787 | 3/1932 | Brisinger | 52/447 |
| 2,138,958 | 12/1938 | Corbett et al. | 52/293 |
| 2,318,820 | 5/1943 | Voight et al. | 52/303 |
| 2,340,911 | 2/1944 | Urbain | 52/488 |
| 2,370,638 | 3/1945 | Crowe | 52/408 |
| 2,970,676 | 2/1961 | Maciunas | 52/488 |
| 3,149,693 | 9/1964 | Keller et al. | 52/483 |
| 3,225,434 | 12/1965 | Van Der Lely et al. . | |
| 3,256,652 | 6/1966 | Van Der Lely . | |
| 3,289,382 | 12/1966 | Van Der Lely . | |
| 3,292,327 | 12/1966 | Van Der Lely . | |
| 3,312,585 | 4/1967 | Hamme | 52/309.13 |
| 3,350,257 | 10/1967 | Hourigan et al. | 52/309.15 |
| 3,377,755 | 4/1968 | Stucky et al. . | |
| 3,401,497 | 12/1968 | Gregory et al. | 52/334 |
| 3,442,056 | 5/1969 | Van Der Lely et al. . | |
| 3,470,660 | 10/1969 | Van Der Lely et al. . | |
| 3,484,999 | 12/1969 | Van Der Lely . | |
| 3,550,334 | 12/1970 | Van Der Lely . | |
| 3,568,380 | 3/1971 | Stucky . | |
| 3,738,069 | 6/1973 | Navarrette-Kindelan . | |
| 3,771,273 | 11/1973 | Brodie . | |
| 3,859,766 | 1/1975 | Flotow et al. | 52/483 |
| 3,925,679 | 12/1975 | Berman et al. | 52/79.1 |
| 3,940,890 | 3/1976 | Postlethwaite . | |
| 4,012,871 | 3/1977 | Netto et al. . | |
| 4,023,315 | 5/1977 | Stucky . | |
| 4,048,769 | 9/1977 | Van Der Lely et al. . | |
| 4,065,905 | 1/1978 | Van Der Lely . | |
| 4,077,170 | 3/1978 | Van Der Lely . | |
| 4,083,159 | 4/1978 | Hatch et al. | 52/309.14 |
| 4,161,089 | 7/1979 | Omansky | 52/262 |
| 4,404,114 | 9/1983 | Mohr et al. | 252/75 |
| 4,424,650 | 1/1984 | Van Note | 52/96 |
| 4,432,178 | 2/1984 | Taft | 52/334 |
| 4,454,695 | 6/1984 | Person | 52/334 |

FOREIGN PATENT DOCUMENTS

| | | | |
|---|---|---|---|
| 155904 | 3/1964 | Australia | 52/263 |
| 1259041 | 3/1961 | France | 52/745 |
| 76805 | 12/1970 | German Democratic Rep. | 52/79.1 |

*Primary Examiner*—James L. Ridgill, Jr.

*Attorney, Agent, or Firm*—Wellington M. Manning, Jr.

[57] ABSTRACT

A transportable building module including a load-bearing support frame which includes a pair of spaced apart portal frames, a floor frame and a roof frame. The floor frame includes two elongated open web trusses having tubular floor purlins secured in spaced relationship therebetween. Reinforcing floor elements are secured to the upper surfaces of the open web trusses and the floor purlins. Reinforcing mesh is draped across the area of the frame to receive a reinforced concrete slab floor with the mesh being received around the upstanding reinforcing elements. Clip elements may be received around peripheral reinforcing elements, if needed for peripheral reinforcement, and a concrete slab is produced in situ about the floor frame, encapsulating the reinforcing elements, which concrete floor will undergo transit of the building module without damage. The roof frame includes longitudinal tubular beams with roof purlins secured therebetween, the purlins having a predetermined slope across the width of the module, such that a roof secured thereto will have a like slope. Non-load bearing exterior and interior wall structures are secured to the load bearing support frame system which conceal the structural elements of the frame. Each individual module is virtually complete when it leaves the factory and has structural integrity, such that connections between adjacent modules generally do not require structural connections other than necessary to ensure coplanarity of adjacent surfaces.

24 Claims, 32 Drawing Figures

MODULAR BUILDING SYSTEM AND BUILDING MODULES THEREFOR

BACKGROUND OF THE INVENTION

The present invention relates to a modular building system and to individual modules or components that are useable therewith. Individual modules are at least substantially finished in a factory environment according to a predetermined design, after which they are transported to a proposed building site where they are set in place as a single module structure, or are coupled to other modules to yield a composite structure. A significantly short period of time is consumed at the building site due to the high degree of completion of the unit achieved at the factory.

Modular concepts of construction, in which individual building modules are pre-fabricated and moved to a building site, and secured to additional modules to produce a desired structure are well established in the art. Similarly other known modular techniques involve remote prefabrication of components followed by component erection and completion of the structure at the building site. Generally speaking, however, both of the noted prior modular concepts have been fraught with problems and/or inherent limitations, such that the use of same has been severely limited. Specifically, while transport of the prefabricated module has precluded use of many conventional materials and has limited architectural design due to dimensional and structural considerations, prefabrication of components only, through less stringent in transport restrictions is both labor intensive and time consuming at the building site.

Exemplary of prior attempts at prefabrication of modules include the manufacture of rectangular-shaped modules which are limited in design and use by virtue of the necessity for supports internally of the modules. Such internal supports limit coupling of modules, restrict placement of internal walls within the module, or protrude into the intended useable interior where the supports must be enclosed, presenting aesthetically undesirable interior module features. In general, necessity for the internal supports has been dictated by lack of structural integrity of the system, per se, and in fact, one such system employs one or more temporary vertical supports during the manufacture of the module which remain in place until the modules are connected into a composite structure, at which time additional hidden supports are provided adequate to permit the removal of the temporary internal supports, whereby an unobstructed interior of at least a portion of the composite structure is achieved.

Other systems avoid the above noted problem by designing the module so that critical support elements are located around the exterior of the module. In these systems, though the interior of the modules may be unobstructed, the exterior becomes potentially aesthetically unappealing. Further, in both of the above described systems, the structural frames employed limit the modules to use in a totally cubic deployment.

Due to the lack of structural integrity of the individual prefabricated modules of the prior art, individual modules are generally assembled into a composite building with the aid of tensioning cables, tie rods, rigid support couplings, support beams that extend across joints between modules and the like. These various means that are utilized to strengthen the prior art modules are adequate to perhaps properly unite adjacent modules into an overall structure, but are not adequate to overcome the patent lack of structural integrity of the modules per se which may be ascertained simply by movement about the interior of the structure. By way of example, one outstanding noticeable feature of normal modular construction is a lack of stability and rigidity of the floor. Normally floors in prefabricated, transportable structures exhibit resilience when one walks thereacross due to a lack of strength or rigidity that is exhibited by conventional flooring.

Prior attempts to overcome the noticeable floor effect of prefabricated construction have included fabrication of the floor from a reinforced concrete floor or conventional material at the building site, or the placement of structural reinforcement beneath the module at the building site, both of which detract from the efficiencies of the system, per se. In fact, prior to the present invention, there has been no modular construction that has employed a factory fabricated lightweight, reinforced concrete floor in the module which could be successfully transported from the factory to the building site without damage to the floor.

Prior art modular building systems involving fabrication of modules in a factory, followed by transport of the virtually completed module to a building site have followed two general structural techniques. One such technique includes exterior load bearing walls to achieve the degree of structural integrity and rigidity necessary for transportability of the module, and in fact, such modules generally include exterior load bearing walls of reinforced concrete, which is both architecturally and aesthetically limiting to the system. The second structural technique for such modular systems involves the inclusion of a load bearing structural framework to which non-load bearing exterior and interior walls are suitably affixed. Vertical load bearing columns are utilized in the framework, generally located at the four corners of the rectangular shaped module and at intermediate locations therebetween. The vertical columns may be secured between horizontal structural elements of the framework for the floor and roof of the module, or alternatively, the horizontal framework elements may be secured to the columns. Such structural framework arrangements of the prior art possess inherent disadvantages due to the requirement for intermediate supports between corner vertical supports, exposure of the vertical support columns around the exterior of the module, or the necessity to enclose the protruding vertical columns within the interior of the module.

All in all, reflecting on prior art modular construction systems, no system has existed heretofore in which basically conventional construction materials were utilized as would normally be found in an office, an industrial building, or a dwelling that was totally constructed on site. With the present invention, however, the modules, after virtually complete fabrication in the factory, are transportable to the building site without dmmage during transit. At the building site the modules are placed in the appropriate configuration according to the intended design for the structure, and adjacent modules are coupled to each other to ensure continuity of planar surfaces within the modules, such as the walls, floors, ceilings and the like, and generally without the necessity of additional structural coupling of the modules.

Insofar as the modular system according to the present invention is concerned, a number of important features are present that are totally devoid and unsuggested by the prior art. First, no internal supports are generally necessary other than at the corners of a basic support frame, whereby an endless series of modules could be coupled in side-by-side or end-to-end fashion to achieve any desired architectural arrangement compatible with conventional construction. In fact, if desired, modules according to the present invention may even be utilized in construction according to architectural designs other than the basic cubic or rectangular configuration. Cantilevered sections may be added to the basic support frame. Further, conventional materials are utilizable without damage during transit. Hence, once the modules are assembled at the building site and the finishing touches added, the overall structure from an exterior and an interior viewpoint is virtually undetectable as being modular in nature. Instead, though the houses constructed according to the present invention are modular in nature, once completed, the structure gives the appearance of a conventionally constructed building. In fact, as opposed to the norm for modular structures, maintenance and repairs to electrical or plumbing lines and conduits, and air handling ducts are easily achieved without destruction of a wall of the module.

Further, heretofore, modular structures that were intended for transport could not satisfactorily include monolithic concrete floors or gypsum type wall board panels, for during transport with the prior modular structures, damage would occur to both. According to the present invention, however, a monolithic reinforced concrete floor is employed that is capable of withstanding transit without even hairline fractures occurring in same, while in like fashion, gypsum wall panels may be utilized as interior wall surfaces without a danger of same becoming unsecured from the wall studs or fracturing as the result of induced stress during transit.

In general, while the prior art in the area of modular construction is quite voluminous, as exemplified below, none of the known prior art teaches or suggests the present invention. Exemplary of the prior art are the following listed patents.

| | |
|---|---|
| U.S. Pat. No. 3,225,434 | U.S. Pat. No. 3,568,380 |
| U.S. Pat. No. 3,256,652 | U.S. Pat. No. 3,738,069 |
| U.S. Pat. No. 3,289,382 | U.S. Pat. No. 3,771,273 |
| U.S. Pat. No. 3,292,327 | U.S. Pat. No. 3,940,890 |
| U.S. Pat. No. 3,377,755 | U.S. Pat. No. 4,012,871 |
| U.S. Pat. No. 3,442,056 | U.S. Pat. No. 4,023,315 |
| U.S. Pat. No. 3,470,660 | U.S. Pat. No. 4,048,769 |
| U.S. Pat. No. 3,484,999 | U.S. Pat. No. 4,065,905 |
| U.S. Pat. No. 3,550,334 | U.S. Pat. No. 4,077,170 |

SUMMARY OF THE INVENTION

It is an object of the present invention to provide an improved system of modular construction.

Another object of the present invention is to provide an improved building module that may be fabricated in a factory and transported to a building site without damage to components of the module.

Still another object of the present invention is to provide an improved building module that is transportable in nature and has adequate strength and rigidity that the module may be placed adjacent another module according to a building plan without structural reinforcement.

Yet another object of the present invention is to provide a modular building system that has extreme architectural design flexibility, and with buildings produced therefrom being virtually indistinguishable from conventionally constructed buildings.

Still further, another object of the present invention is to provide a modular building system in which a composite building may be constructed of a plurality of modules constituting a plurality of stories where the individual modules need only be stacked one atop the other with appropriate interfacing.

Still further, another object of the present invention is to provide an improved module that is lightweight in nature, has a monolithic concrete floor, no load bearing walls, and is capable of having cantilevered sections located at one or both ends of same.

Still further, another object of the present invention is to provide an improved building module that affords easy access to utility support systems for maintenance and repair.

Generally speaking, the transportable module according to the present invention comprises a generally rectangular load bearing support frame, said frame comprising a vertical column at each corner of the rectangle, spaced apart first and second tiers of longitudinal and transverse horizontal elements secured to said columns, and spaced apart transverse horizontal elements secured between said longitudinal horizontal elements in said first and second tiers, said first tier of horizontal elements being located inwardly from a lower end of said columns and generally defining a frame for a floor for said module, said second tier of horizontal elements being located adjacent an upper end of said columns and generally defining a frame for a roof for said module, said columns and peripheral horizontal elements on each side of said module being located in common vertical planes; a floor structure received about said first tier of horizontal elements and secured thereto; a roof structure received about said second tier of horizontal elements and secured thereto; outer, non-load bearing wall elements secured to said frame along all intended exterior sides of the module and concealing said frame thereat; and interior, non-load bearing wall and ceiling structures secured to said frame at predetermined locations within said module and concealing said frame thereat, said frame having adequate strength and rigidity to support said entire module, and said floor structure, outer wall elements and interior wall and ceiling structures being adapted to withstand transit of said module without significant damage thereto.

More specifically, a single module unit according to the present invention includes a load bearing support frame system that is totally concealable within walls of the finished unit and is capable of independent or composite deployment on a foundation without any additional structural support. The support frame as described above includes a pair of portal frames located at opposite ends of the basic module, being interconnected by longitudinal upper and lower elements secured therebetween, though as pointed out hereinafter, a further frame section may be attached to outer ends of either or both portal frames to define a cantilever module section thereat. Each portal frame preferably includes a pair of vertical tubular columns that are secured in spaced apart relationship by transverse horizontal tubular beams located adjacent the upper and lower ends of same. Upper longitudinal horizontal elements that interconnect the portal frames are preferably tubular steel while the lower elements are preferably open web trusses. Spaced apart transverse tubular beams or purlins are secured between the upper longitudinal beams and the lower open web trusses. Such structure constitutes the preferred basic support frame for a module according to the present invention, which, as mentioned above is devoid of any supports interior of the module volume, and which is adequate to carry the full load of the finished module. Should load requirements dictate, however, such as might be present on lower modules in a vertical stacking arrangement, the basic module frame may also include cross bracing elements located diagonally between upper and lower horizontal frame members. Cantilever sections, if added to the basic module frame, include an upper and lower longitudinal beam secured at one end to the outer side of an appropriate portal frame column and at an opposite end to a vertical connector column. The two vertical connector columns are interconnected with upper and lower transverse tubular beams secured at terminal edges of same.

The module floor is preferably a monolithic, reinforced concrete slab which has a very specific construction, whereby the floor, though relatively lightweight in nature, has adequate rigidity and strength that fractures do not occur in the concrete during transit of the module. Basically, the portion of the support frame to receive the floor includes the longitudinal open web trusses which are secured at opposite ends to the portal frame columns, the transverse tubular beams or purlins that are secured in spaced apart relationship between the trusses, the lower transverse horizontal tubular beams of the portal frames and, if appropriate, lower horizontal beams of the cantilever frame. Shear connectors are secured to upper surfaces of beams and trusses where the floor is to be produced and extend upwardly therefrom. A reinforcing mesh is then draped across the area where the floor is to be produced, with the shear connectors being received through the interstices of the mesh. With appropriate forms secured around the periphery of the skeletal floor frame and extending upwardly between the transverse tubular beams, concrete is poured into the space defined by the form. A monolithic concrete slab is thus produced in situ, totally encapsulating the reinforcing mesh and the shear connectors. A lower surface of the concrete is preferably coterminous with an upper surface of the transverse tubular beams. Around the outer periphery, the floor may terminate at the outer edge of the open web trusses or extend beyond same, depending upon design of the particular module. In those instances when the floor is to be cantilevered from the outer edge of the open web trusses, or when a partition wall is to be adjacent an outer edge of the floor, further individual reinforcing members are provided about the peripheral shear connectors to further reinforce the outer periphery of the concrete slab.

The roof of the individual module units is preferably planar in nature and is secured to the roof purlins, within the peripheral roof frame elements. The roof purlins, as mentioned above, are tubular elements that extend across the width of the module and are so secured to provide a predetermined slope for each purlin. Planar roofing materials secured to the purlins thus present a like predetermined slope across the module roof to facilitate drainage of water from the roof. Preferably, the purlins are so situate that the roof of the module slopes downwardly from one side of the module to the other and diagonally outwardly from a point intermediate the module length towards both opposite corners. The roof, per se, preferably includes a plurality of planar panels, such as plywood, secured to the purlins with self-tapping screws. Individual panels are adhesively secured together to form a continuous planar surface. A layer of a waterproof material, such as a polymer film is secured to the planar surface totally across the roof area and extends over the edge of the roof and downwardly for a short distance along the frame. The roof, when finished, is located beneath the upper level of the longitudinal horizontal frame elements and as set forth hereinafter has a parapet therearound. While the above description of the roof is directed to a generally flat roof, obviously a gabled or other type roof, or a segment of same, may be applied to the individual module according to conventional construction techniques.

A non-load bearing, outer cladding wall, exemplified by fiberglass reinforced concrete panels is provided around the periphery of the module where it is intended that an exterior wall be present. Preferably, the cladding panels are secured at a lower end to vertically slotted brackets that are secured to the floor of the module, and at an upper end, to vertically slotted brackets that are secured to the support frame. The cladding panels though non-load bearing in the context of the module, obviously must be constructed to support the load of the panel, per se. The plain panels are thus provided with reinforcing ribs along the length and width of the interior of same, with longitudinal ribs along the outer edges having a thickened medial portion that tapers towards opposite ends of the panel. Each panel has a predetermined outer surface design, and is adequate in length to extend from a level below the floor of the module to a level above the roof of the module, and a top of the panel defines an inturned flange section. Once the panels are secured to the module frame adjacent panels may then be secured at the thickened medial portions of the outside ribs with an appropriate bracket to ensure planarity of the exterior wall surface. Also, appropriate materials are preferably applied in the joints between the panels to seal the gap between same while at the same time allowing for thermal expansion and contraction. Where a single story building structure is anticipated, the portion of the cladding panels below the floor level serves as a skirt around a crawl space below the module. At the top of the module, the inturned flange extends inwardly, above the module frame and defines a portion of a parapet around the module at the roof level. Vertical displacement of the panel from the upper level of the frame defines an entrance to a ventilating passageway and provides an overflow capability for the module roof as will be described hereinafter.

Cladding panels are also designed to receive window or door units or the like. Such panels in addition to the features noted above, define an appropriate opening for receipt of the particular unit. Each such opening is bordered by an inturned panel section which generally negates the need for the thickened vertical ribs along the outer edges of the panels.

As mentioned above, the exterior wall is a non-load bearing cladding wall, and though the fiberglass reinforced concrete panels are preferred, any available construction materials may be utilized, so long as the requisite qualities of same are consistent with the teachings of the present invention.

In a most preferred embodiment according to the present invention, a composite wall of the module includes the exterior cladding wall with a continuous vapor barrier located internally of same, preferably being located outside the support frame. The vapor barrier extends vertically along the height of the module, and is held apart from an inside surface of the cladding panel by the reinforcing ribs to define the ventilating passageway, along the height of the module, as well as a water overflow passageway from the roof. An appropriate layer of an insulation material is provided internally of the vapor barrier with a stud wall being located internally from the insulation and support frame. An appropriate interior wall is then secured to the stud wall and decorated as desired.

Problems exist with a transportable module should both ends of the stud wall be rigidly secured to the module frame or some appurtenant structure. Accordingly, in a most preferred arrangement, the wall studding is only rigidly secured to the floor of the module while upper ends of the studs are secured for flexing adjacent the roof of the module, whereby during transit of the module, harmonic vibrations will not cause rupture of the studs. Still further, most preferably, the upper ends of all the wall studs are united into a composite unit, whereby the overall stud wall structure may absorb the transit stress without rupture.

Certain interior wall panels are secured to the stud walls as mentioned above according to conventional techniques with appropriate interior decorative materials applied thereover. Moreover, gypsum wall panels, which heretofore could not be employed in a transportable module, may likewise be employed. Gypsum wall panels are secured to the stud walls with appropriate fastening members, preferably self-threading screws. It is generally necessary to then apply a reinforcing medium atop the gypsum panel and across joints between same to preclude against fracture of the panel during transit and to preclude against withdrawal of the fastening members due to vibration. Preferred techniques for reinforcing the gypsum panels include an adhesive securement of a suitable fabric, such as a fiberglass fabric entirely across the interior surface of the panels and the joints between same, or alternatively application of a flexible polymer coating thereacross. A ceiling grid may be secured to the upper end of the stud wall and ceiling material secured thereto. Likewise, other conventional interior decorative materials may be utilized to finish the interior of the module as desired.

Prior to the installation of the interior wall structures, conventional electrical, plumbing, and heating and air conditioning lines, conduit, ducts or the like may be installed within the wall space, beneath the floor, or the like, such that when the module is delivered to the building site, appropriate connection can be made to the utility systems of adjacent modules.

Once the modules for a particular composite building are fabricated in the factory, and the foundations are prepared at the building site, the finished modules may be delivered and set up to form the composite building. Since each module is self-supporting, it is generally only necessary to properly position the module with respect to its adjacent modules, secure the module to its foundation, make connections between modules for continuity of wall or floor surfaces, connect the utilities and finish interior surfaces at module joints or the like. In instances, however, when load requirements dictate further reinforcement of the module, same can be achieved without deleterious effects to the architectural advantages of the present system. The finished structure may thus assume the appearance of a conventional "stick-built" house or building.

BRIEF DESCRIPTION OF THE DRAWINGS

FIG. 1-A is a partial side elevational view of the support frame, illustrating preferred initial connection between the vertical columns and the open web trusses.

DESCRIPTION OF THE PREFERRED EMBODIMENTS

Making reference to the Figures, preferred embodiments of the present invention will now be described in detail. Modular units manufactured according to the present invention may be employed individually, or may be placed adjacent or atop other similar units to provide a building of a predetermined design. Accordingly, both aspects will be described hereinafter. As to the individual modules themselves, for clarity sake, the various components used in same will be separately described.

In general, modules produced according to the present invention are totally self-supporting, in that, when placed side by side or atop another module to form a building cluster, there is no requirement as with other prior art building modules to make horizontal and/or vertical structural connections therebetween except as necessary to ensure planarity or continuity of walls, floors and the like. When, however, load requirements on a module dictate further reinforcement, the connections between modules may transmit support between modules that enables retention of the unusual architectural flexibility achieveable therewith. Furthermore, the present modules include a structural frame that is the sole load bearing segment for the unit, with a floor, a roof, non-load bearing, exterior cladding walls and non-load bearing interior walls associated therewith according to a predetermined design, and in such a fashion that not only can the module be transported for significant distances without structural or aesthetic damage to the completed structure, but also, once the modules are properly placed according to the design of the building to be constructed, the structure can be finished on site to a point where it is indistinguishable, without close inspection, from a conventionally constructed building.

Set forth hereinafter are the descriptions of the various preferred components of a module according to the present invention.

Structural Frame—Basic

Figures 1, 1A:
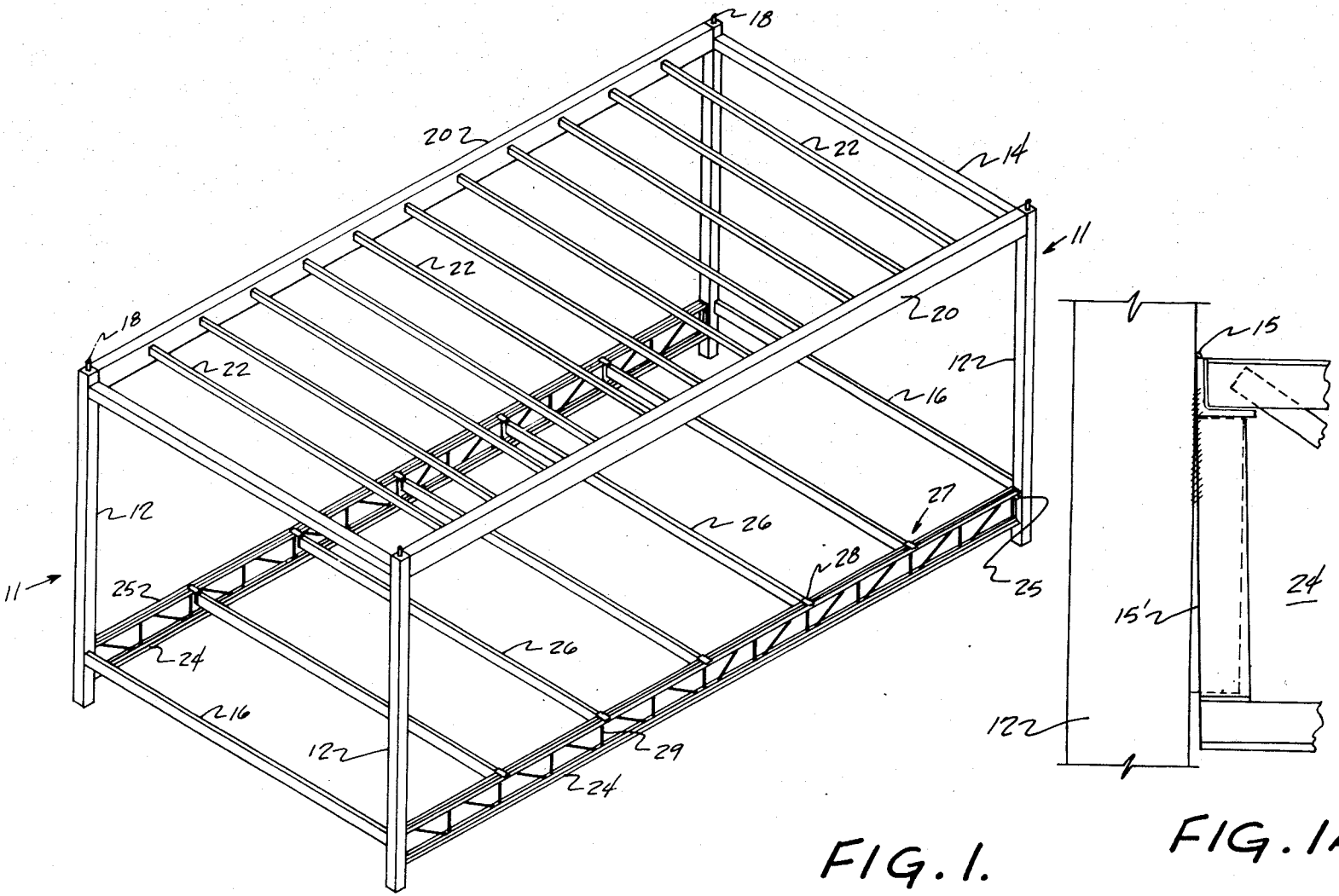
FIG. 1 is an isometric view of a basic support frame for a mcdule according to teachings of the present invention.

The basic structural frame for a module according to teachings of the present invention is illustrated in FIG. 1 generally as 10 and includes a pair of portal frames generally indicated as 11 located at opposite ends of the basic module structure. The portal frames include spaced apart vertical columns 12 that are located at the four corners of the basic module with upper and lower transverse horizontal tubular beams 14 and 16, respectively, secured therebetween. Upper transverse tubular beams 14 are secured between vertical support columns 12 inwardly from an upper portion of same, which generally defines location for the roof of the module, while lower transverse horizontal beams 16 are secured inwardly from the bottom ends of vertical columns 12, locating the general floor area of the module. Tubular steel is preferred for the portal frame elements, as well as certain of the other frame elements due to the strength-weight ratios for same, though other materials may be employed so long as the desired characteristics of strength and rigidity are achievable without unduly increasing the overall weight of the module. Each vertical column 12 is provided with a connector pin 18 at an upper end of same and a receiving recess 13 in a lower end of same (See FIG. 12), the purposes of which will be described hereinafter. Transverse horizontal tubular elements 14 and 16 of the portal frames 10 extend across the module, and in combination with the thickness of the vertical columns generally establish the width of the module.

Opposite portal frames 10 have longitudinal horizontal tubular frame elements 20 secured to vertical columns 12 of same, coplanar with an upper end of columns 12. A plurality of roof purlins 22 are secured between longitudinally extending frame elements 20 in spaced apart relationship, with each individual purlin 22 preferably having a particular slope across the width of the module according to the particular position of same along the module length, the purpose of which will be described more fully hereinafter. At the lower end of the module, an open web truss 24 is secured between opposite portal frame columns 12 with an upper chord 25 of trusses 24 being coplanar with an upper surface of transverse tubular elements 16 of portal frames 10. The open web trusses 24 and the transverse tubular beams 16 may generally define the perimeter of the floor of the module. A plurality of transverse floor beams or purlins 26 are secured between trusses 24 by L-shaped brackets generally 27, one leg 28 of which is secured to top chord 25 of truss 24 with a depending leg 29 being secured to an end of the floor beams 26 (See FIG. 13). Floor beams 26 provide internal support for the module floor as will be further described in detail hereinafter, and an upper surface of same is coplanar with top chord 25 of truss 24.

Dimensionally speaking, it is preferable that the width of the module be of the maximum dimension that may be legally transportable across open roads and highways. A preferred completed width is about 4.0 meters. Basic module length is preferably from about 7.0 meters to about 8.0 meters, though as set forth below, module length may be extended up to about 10 meters, all without loss of strength, rigidity or stability of the module.

Structural Frame—Cantilevered

Figure 2:
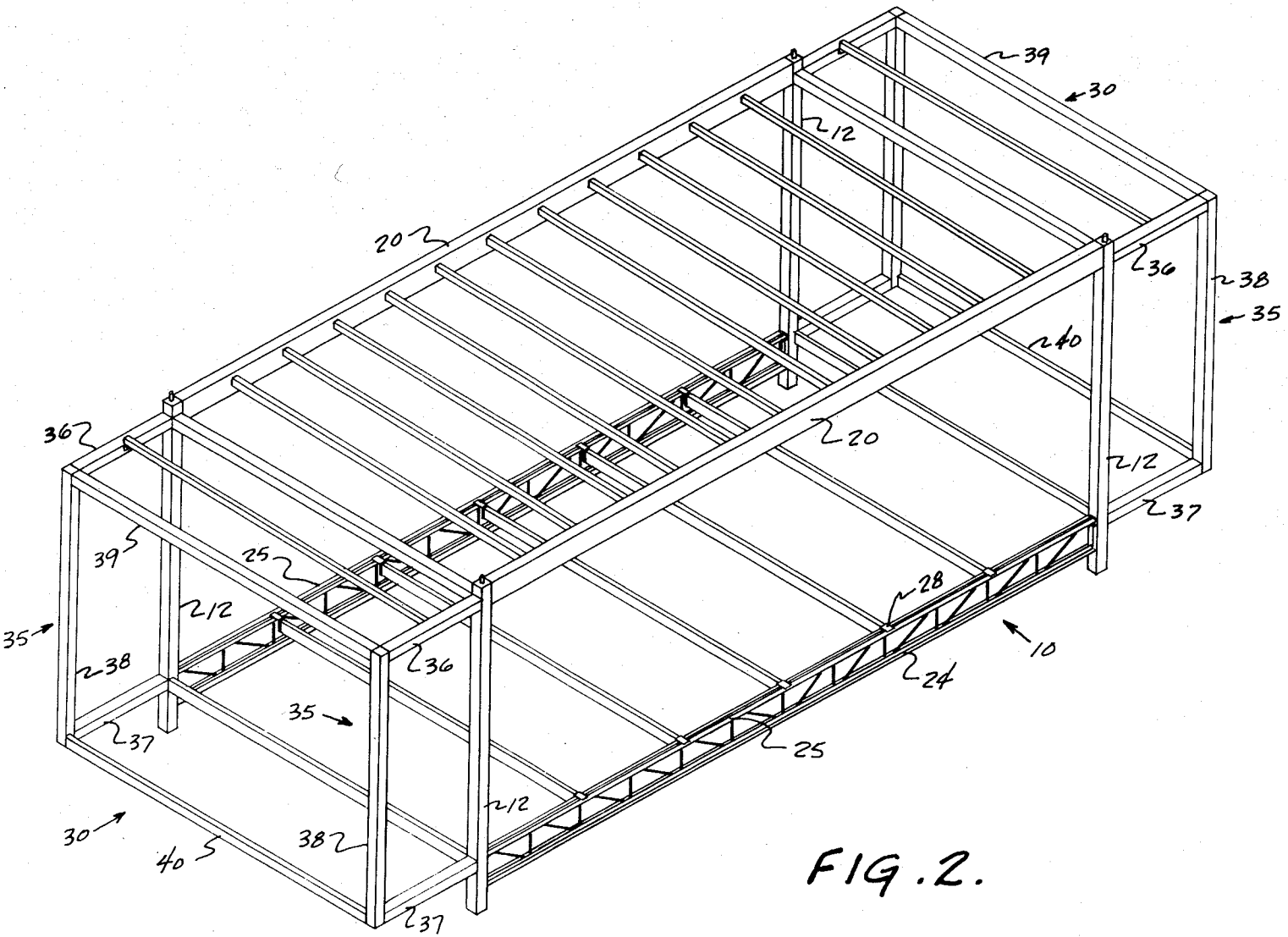
FIG. 2 is an isometric view of a support frame according to teachings of the present invention showing cantilevered sections at opposite ends of same.

Making reference to FIGS. 1 and 2, it can be seen that the basic module as described with respect to FIG. 1 can be extended at either or both ends of same by the securement of a structurally defined, three dimensional cantilever section generally 30 to the two portal frame columns 12 at the particular end being extended. The capability of providing the cantilever sections at either or both ends of the basic module reduces stress on the vertical columns, but primarily adds appreciably to the architectural design capabilities with which modules of the present invention may be employed. As will be more particularly described hereinafter, the cantilever sections may supply an extended volume to the interior of the basic module, or may serve as a patio, balcony or the like, and though not shown in the drawings permits deviation from a purely rectangular structure which further adds to greater design variation capability. For example, the frmme defining the cantilevered sections may increase or decrease in width from the vertical columns outwardly to the end of same.

Making particular reference to FIG. 2, the framework within the space defined by the four vertical columns 12 of the opposite portal frames is identical to that set forth in FIG. 1. Cantilever sections 30 are secured at opposite ends of the basic module with components of the cantilever section being secured to the portal frame columns 12. Cantilever sections 30 each include a pair of frames generally indicated as 35 that reside in the same vertical planes as their respective columns 12. Each cantilever frame 35 includes upper and lower longitudinal beams 36 and 37, both of which are secured at one end to its portal frame column 12 and at an opposite end to a vertical beam 38. A lower surface of upper longitudinal beams 36 is coplanar with a lower surface of longitudinal upper beams 20 of the basic module, while at a lower end, upper surfaces of longitudinal beams 37 are coplanar with upper surfaces of top chords 25 of open web trusses 24. Frames 35 of the cantilever sections 30 are secured to each other by transverse upper and lower tubular beams 39 and 40, the respective upper and lower surfaces of same being coplanar with like surfaces of longitudinal beams 36 and 37 of the cantilever portal frames 35. As is illustrated in FIG. 2, a single roof purlin 22 may be secured between upper longitudinal beams 36 while at a lower end of the cantilever section 30, the length of the cantilever section is such that no additional floor beams or purlins 26 are required, though obviously variance to same is permissible. Note also from FIG. 2 that while the planarity of certain surfaces of the cantilever section 30 as described above is very important to the cantilevered, extended module of the present invention, that the top and bottom edges of both the longitudinally extending beams 36 and 37 are located inwardly with respect to the corresponding outer edges of longitudinally extending beams 20 and open web trusses 24 respectively.

With the cantilevered module as described above, due to the alignment of certain surfaces of the frame for same, the module floor may continue uninterrupted along the entire length of the module, or alternatively, should it be desirable to utilize either cantilever section 30 as a balcony, patio or the like, the monolithic concrete floor of the basic module may terminate at the portal frames, and an additional, laid in floor may be provided for the cantilevered section 30. Similarly, with the roof purlins 22 being provided in the cantilever section, the roof of the module as well as the interior ceiling may be continuous along the length of the module or separate as desired according to the architectural design for the particular module.

Further regarding the particular structure of the framework of the module, the particular components of same and the particular arrangement of components afford great flexibility in the placement of pipe, conduit, electrical conductors and ducts for electrical, plumbing, heating and air conditioning uses and the like. At the same time, access is available to same without destruction of walls of the module, which feature has heretofore been impractical, if not totally unavailable. Particular details of such features will be described in further detail hereinafter.

The Module Generally

Figure 3:
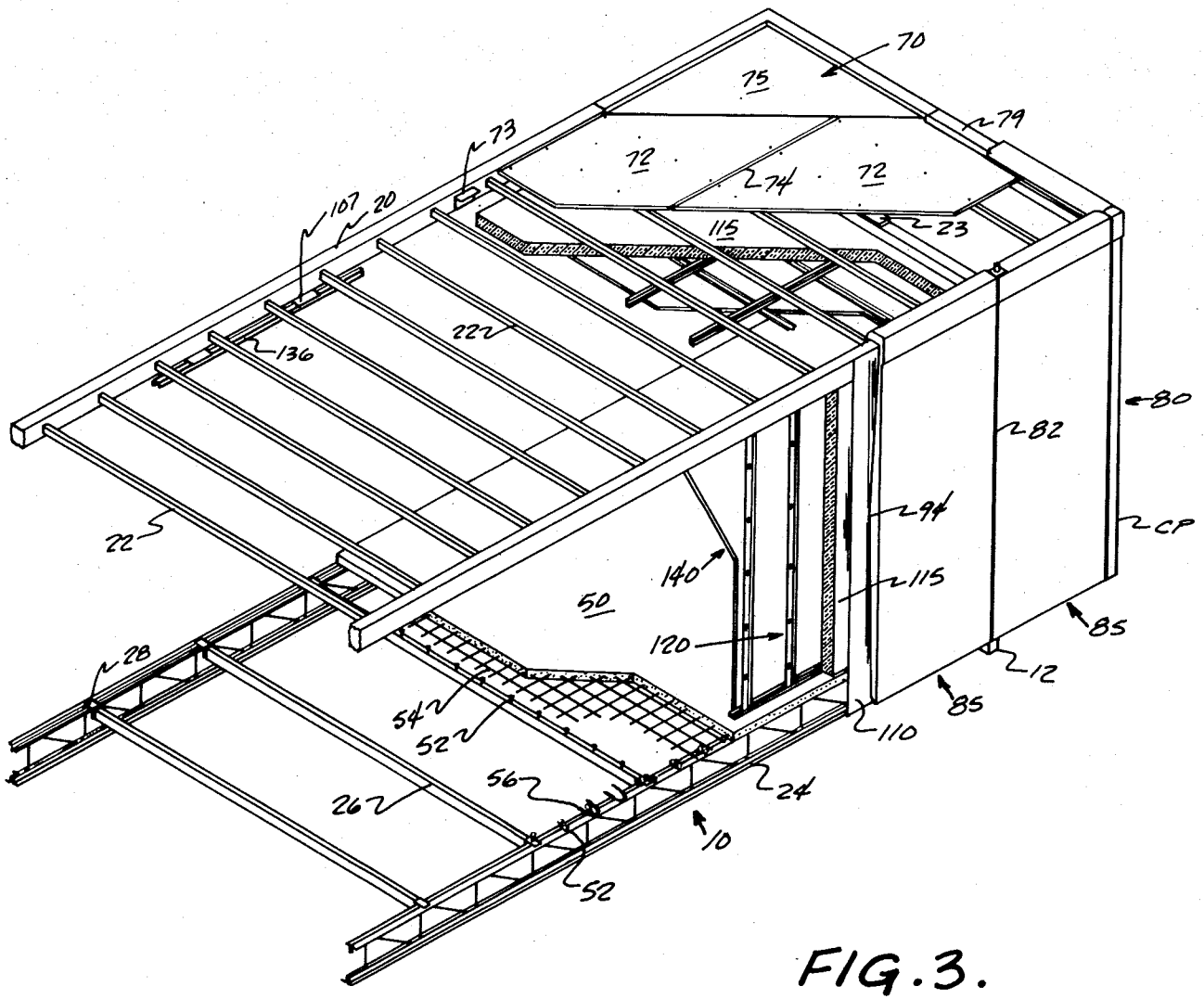
FIG. 3 is a partial isometric cutaway view of a module according to teachings of the present invention illustrating various components of same in their proper relationships.

Making particular reference to FIG. 3, the overall module according to the teachings of the present invention will be described. The structural frame generally indicated as 10 is provided with the load bearing vertical columns 12, (only one of which is shown) which collectively support the module above a foundation, a lower module or the like. A monolithic, reinforced concrete floor 50 is provided across the area of the module to be floored, while a roof generally indicated as 70 is provided atop the module. A non-load bearing exterior wall generally indicated as 80 is secured to the structural frame 10, and as illustrated in FIG. 3, is represented by a plurality of cladding panels generally indicated as 85, which panels are secured to frame 10 in side-by-side relationship around a portion or all of the perimeter of the module. As will be described in detail hereinafter, while plain cladding panels 85 are shown in FIG. 3, other cladding panels are employed which define openings therein for receipt of door, window or other type units. Also, corner panels, and miscellaneous panels of various dimensions are utilizeable to fit into the intended architectural scheme. Internally of cladding panels 85, but outside of frame 10 is a vapor barrier 110 which is preferably a flexible sheet, such as a fabric reinforced polyethylene sheet. Appropriate insulation material 115 such as fiberglass mats is preferably received internally of frame 10 or within frame 10. An interior stud wall generally 120, is located internally of insulation 115 and is provided with a suitable interior surface generally 140 such as gypsum panels. Additionally, below roof 70, an appropriate layer of insulation material 115 is received, beneath which is located a ceiling grid 130 having a suitable interior surface generally 140 secured thereto.

While the module as depicted in FIG. 3 is potentially fully enclosed, as will be seen and discussed hereinafter, portions of the floor, roof and ceiling or exterior walls may be omitted according to the design of the building to be produced therefrom.

Monolithic Reinforced Concrete Floor

Figure 28:
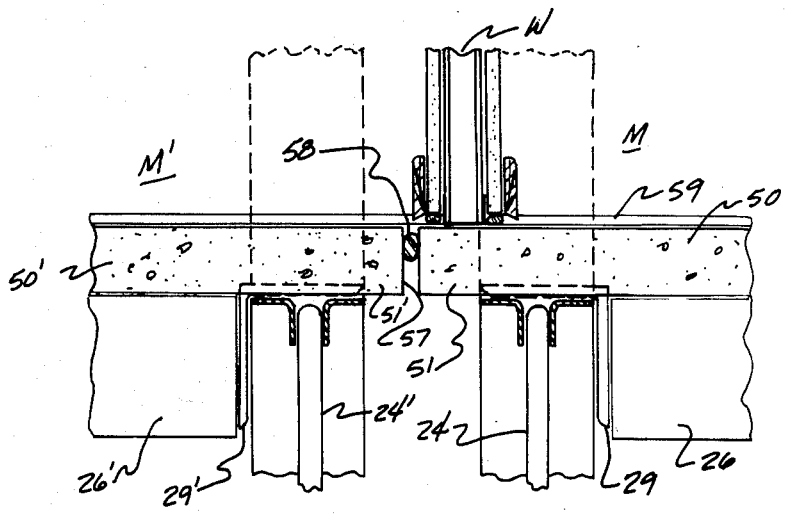
FIG. 28 is a partial cross-sectional view illustrating the juncture between two adjacent modules as would be taken along a line XXVIII—XXVIII of FIG. 7.

Making reference to FIGS. 3, 13 and 28, the preferred monolithic, reinforced concrete floor 50 for modules according to teachings of the present invention will now be described. As set forth above, as a part of the structural frame 10 of the module longitudinal open web trusses 24 are secured between portal frame columns 12 with floor beams or purlins 26 being secured between trusses 24 by way of plates 27 such that the upper surfaces of same are coplanar with the upper surface of top chord 25 of trusses 24. Such along with the lower horizontal beams 16 of the portal frames 10, and if appropriate, the lower horizontal beams 37 and 40 of cantilever sections 30 will define the general area available for receipt of concrete floor 50 if the full area is consistent with the overall building design. It may be desirable, however, to cantilever a floor portion slightly beyond the outer extremities of trusses 24 or the end transverse beams.

In the sense of the present invention, the open web trusses 24 are quite important, in that, an open network is provided, through which piping, conduit, electrical cable or the like may be randomly passed. Where individual modules are positioned side-by-side to yield a composite structure, the capability of virtually unobstructed passage is quite important not only for installation, but also for maintenance and repair. Further, with the floor beams 26 being lesser in height than the open web trusses 24, a greater plenum is provided beneath the floor of the module to define a crawl space along the free length of the module. Moreover, floor beams 26 in a most preferred embodiment are rectangular-shaped tubular steel which are lightweight in nature, have the requisite strength to support the floor, and resist distortion from bending moments created on same during transit of the module.

A plurality of shear connectors 52 are secured to the upper surfaces of each of the structural frame elements to be covered with a concrete floor. As illustrated particularly in FIG. 3, a plurality of pairs of aligned shear connectors 52 are secured along the top chords 25 of open web trusses 24 with single connectors 52 atop brackets 27, or offset on opposite sides of brackets 27. The pairs of shear connectors 52 along trusses 24 afford additional reinforcement along outer edges of the concrete floor, and likewise the symmetrical nature of same avoids the creation of undue forces on the floor during transit of the module. A reinforcing mesh 54, preferably of a heavy gauge wire, is also applied across the area to receive concrete floor 50, with mesh 54 having interstices therein at least adequate to permit the passage of shear connectors 52 therethrough. Additionally, though not shown, spacer elements are provided between the floor beams 26, and atop forms used in manufacture of floor 50 to support mesh 54 between beams 26 to ensure total encapsulation of same within concrete floor 50. Still further, if desired and/or necessary, U-shaped clips or the like 56 (See FIG. 13) may be provided for additional reinforcement around the perimeter of concrete floor 50, being received about the peripheral shear connectors 52 thereat. Reference is made in this regard to FIG. 28 which shows a portion of two side-by-side modules M and M′ having concrete floors 50 and 50′, respectively. With modules M and M′ properly positioned in side-by-side relationship, a small gap 57 remains therebetween, which as illustrated in FIG. 28, may be filled with a suitable mastic 58 or the like. Note in FIG. 28, that floors 50 and 50′ are cantilevered slightly at 51, 51′ beyond the outer peripheral edges of their respective open web trusses 24 and 24′, respectively. An internal wall W is located generally at the junction between modules M and M′, being secured atop cantilevered section 51 of floor 50, where clips 56 or the like further reinforce floor 50 to accommodate same. Hence, in situations, either where the concrete floor 50 cantilevers beyond the outer periphery of its peripheral supports or where an internal partition wall is designed to be placed at the very edge of concrete floor 50, the additional reinforcing clips 56 are preferred to avoid fracture of floor 50 when appropriate mounting means for wall W are secured thereto.

According to the present invention, the floor beams 26 are preferably located on 1,200 millimeters centers which are deemed quite adequate to add appropriate support for a floor 50 that is 60 millimeters in thickness. Obviously, spacings of the floor beams may be varied as well as thickness of the concrete floor so long as the requisite weight and strength characteristics are retained. As described herein, floor 50 is both strong enough to support the intended loads, and rigid enough to undergo transit of the module for extended distances without even hairline fractures occurring therein.

Concrete floor 50 is formed in situ about the appropriate frame in such fashion that shear connectors 52, mesh 54, and reinforcing clips 56 are totally encapsulated within same while a lower surface of floor 50 is coterminous with an upper surface of the support members. In other words, floor 50 preferably terminates on a lower side immediately at the top cord 25 of trusses 24, and the upper surfaces of floor beams 26, portal frame horizontal elements 16, and if appropriate, cantilever tubular elements 37 and 40, whereby the support elements act independently in support of the floor.

Once the structural frame for the floor is produced, appropriate floor forms are received thereabout and secured to the frame members. Particularly, referring to FIG. 3, appropriate forms are placed between floor beams 26 and around the exterior of trusses 24, and if appropriate, cantilevered sections 30, which forms are secured to the frame and transported therewith to a remote site where the floor is poured, cured, and the forms removed. With the forms in place, plywood sheets may be placed thereover such that a planar surface is provided along upper surfaces of the form elements to define an underside of floor 50. Peripheral form members will determine the outer periphery and thickness of floor 50. As mentioned above, to ensure total encapsulation of nesh 54 which is preferably a steel mesh, spacers (not shown) are placed on top of the forms located between floor beams 26 which hold mesh 54 within the area in which the concrete floor 50 will be produced and themselves will become a part of floor 50. After pouring, the concrete is preferably finished by power floating and cured, preferably in an accelerated fashion with the use of heat.

During fabrication of frame 10, the floor frame is installed as a subsection including trusses 24 with floor purlins 26 secured therebetween, with the subsection having a slight upward chamber intermediate the length of same (See FIG. 1-A). Assembly of the floor subsection to the portal frame is thus accomplished by positioning of trusses 24 onto column mounting plates 15, with column brackets 15′ extending into the ends of the trusses. A gap is left between a majority of the length of trusses 24 and columns 12 at a lower end of same and securement is initially made along the top only. Once floor 50 is poured, the camber is removed and plates 15 make full contact against column 12 (shown in phantom). Further weldments can then be effected to ensure proper securement of the frame elements.

Exterior Wall Panels

Making reference to FIGS. 3, 13, 14 and 15–20, the exterior module wall 80 will be described which preferably includes a plurality of cladding panels generally 85.

Only plain cladding panels 85 and a corner panel CP are illustrated in FIG. 3. Cladding panels can also be produced with appropriate openings defined therein to receive window units, door units, air conditioning units or the like as illustrated hereinafter.

Figure 19:
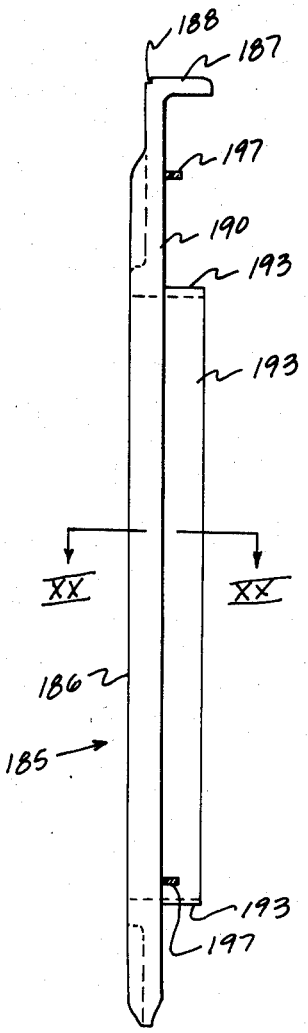
FIG. 19 is an end elevational view of a further embodiment of a cladding panel according to teachings of the present invention.
Figure 20:
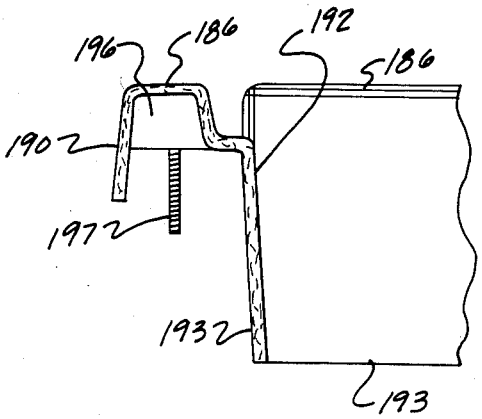
FIG. 20 is a partial cross-sectional view of the panel in FIG. 19 taken along a line XX—XX.

FIGS. 15–18 illustrate the plain cladding panels while FIGS. 19 and 20 illustrate a window panel, door panel or the like. Panel 85 is preferably a glass reinforced concrete structure that is produced according to conventional techniques. Any suitable siding material may be utilized in connection with the present module, however, so long as same can be appropriately secured to the module frame. The glass reinforced concrete panels are produced by spraying concrete of a predetermined consistency with chopped glass fibers onto a female mold for the particular panel. Panels 85 may generally assume any desired shape or configuration, and the outer surface of same may be produced in any desired texture, design or motif, such as, for example, a conventional brick wall, stucco, wood grain, or any such other surface or ornamental characteristic as may be desired.

Panel 85 includes an exterior planar surface 86 that has an inturned flange portion 87 at an upper end of same with a notch 88 located at the turn radius. Interior surface 89 of panel 85 has a plurality of longitudinal ribs 90, 91 and may have one or more transverse ribs 92 provided thereon which protrude outwardly from same. Peripheral reinforcing ribs 90 are thickened along a medial portion 94 of the panel length and taper inwardly towards opposite ends of panel 85. A bolt 95 is provided at thickened medial portion 94 to facilitate lateral connection between adjacent panels 85 as will be defined hereinafter. Further a longitudinal notch 90' is provided at the junction of exterior surface 86 and one peripheral rib 90 for a purpose that will be described hereinafter. A plurality of enlarged pod sections 96 are spaced about the interior surface 89 in which bolts or connectors 97 are received and secured during manufacture of the panel which bolts 97 are utilized for securement of panel 85 to frame 10 of the module, as will be described in detail hereinafter. As mentioned hereinbefore, panel 85 is non-load bearing in nature, whereby the design of same need only be of adequate strength to support the panel, per se. In this vein, the increased thickness at medial portion 94 of peripheral ribs 90 acts as a support beam for the panel, as well as for additional purposes to be described hereinafter.

Making reference to FIGS. 19 and 20, a further panel 185 is illustrated as typifying the type panel that would be employed where it is desirable to locate windows, doors, or the like in the structure. Panel 185 thus includes a planar section 186 which has an inturned flange 187 and a notch 188 at an upper portion of same, and which is provided with longitudinally extending peripheral ribs 190 which are generally uniform in thickness along the height of panel 185. Panel 185 further defines an opening 192 therein having skirt sections 193 depending from planar section 186 around the periphery of same. Bolts or other type connectors 197 are secured within pods 196 during fabrication of panel 185, though, as is illustrated in FIG. 20, the bolts or other securement means 197 are located beside window or door receiving opening 192. Whereas plain panel 85 has the enlarged peripheral rib section 94, as mentioned above, window, door or other material receiving panels 185 do not have such, for the skirt sections 193 that define the opening 192 afford sufficient rigidity that the thickened peripheral flange is not required.

Figure 4:
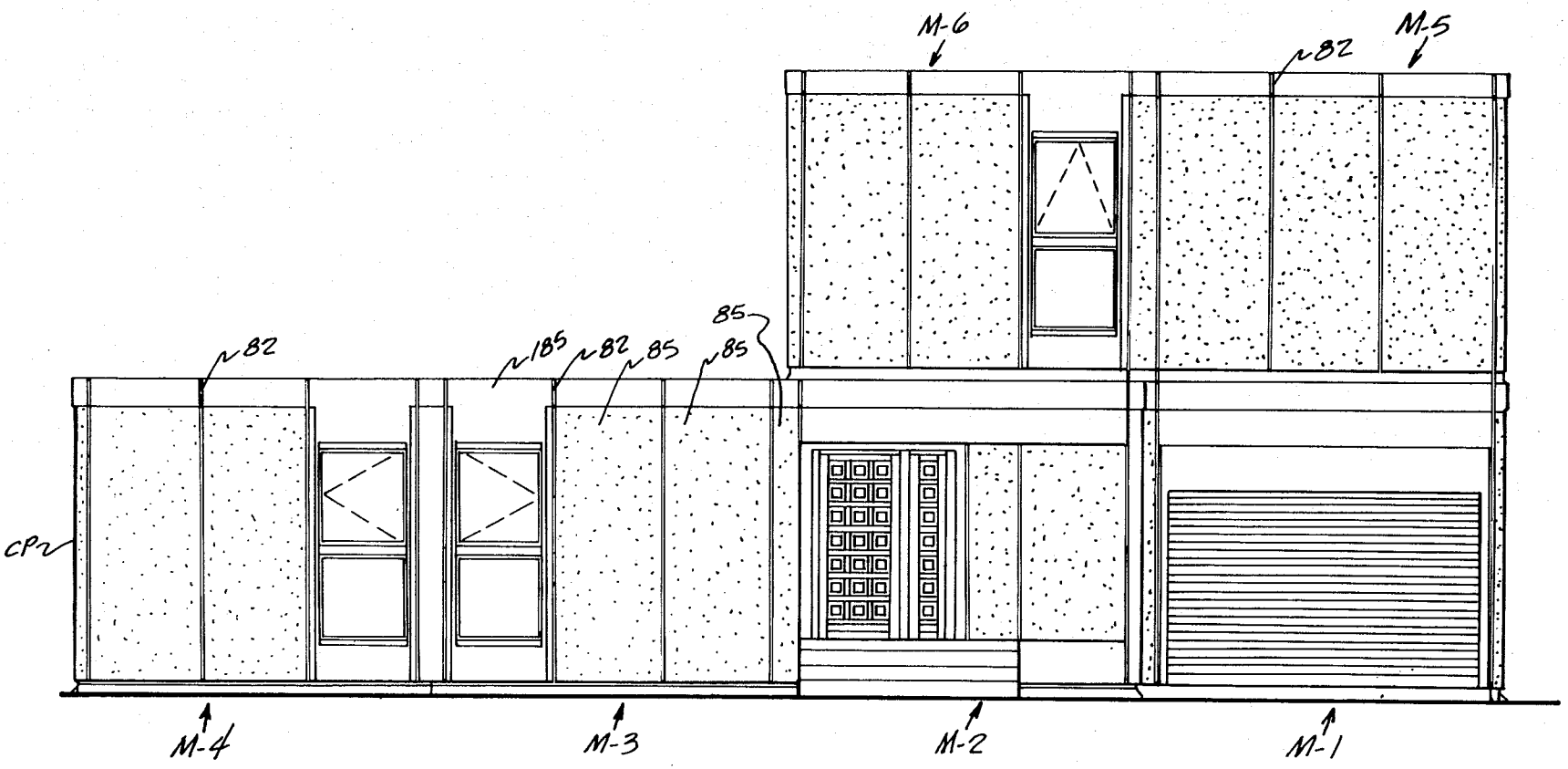
FIG. 4 is a front elevational view of a modular building according to teachings of the present invention.
Figure 5:
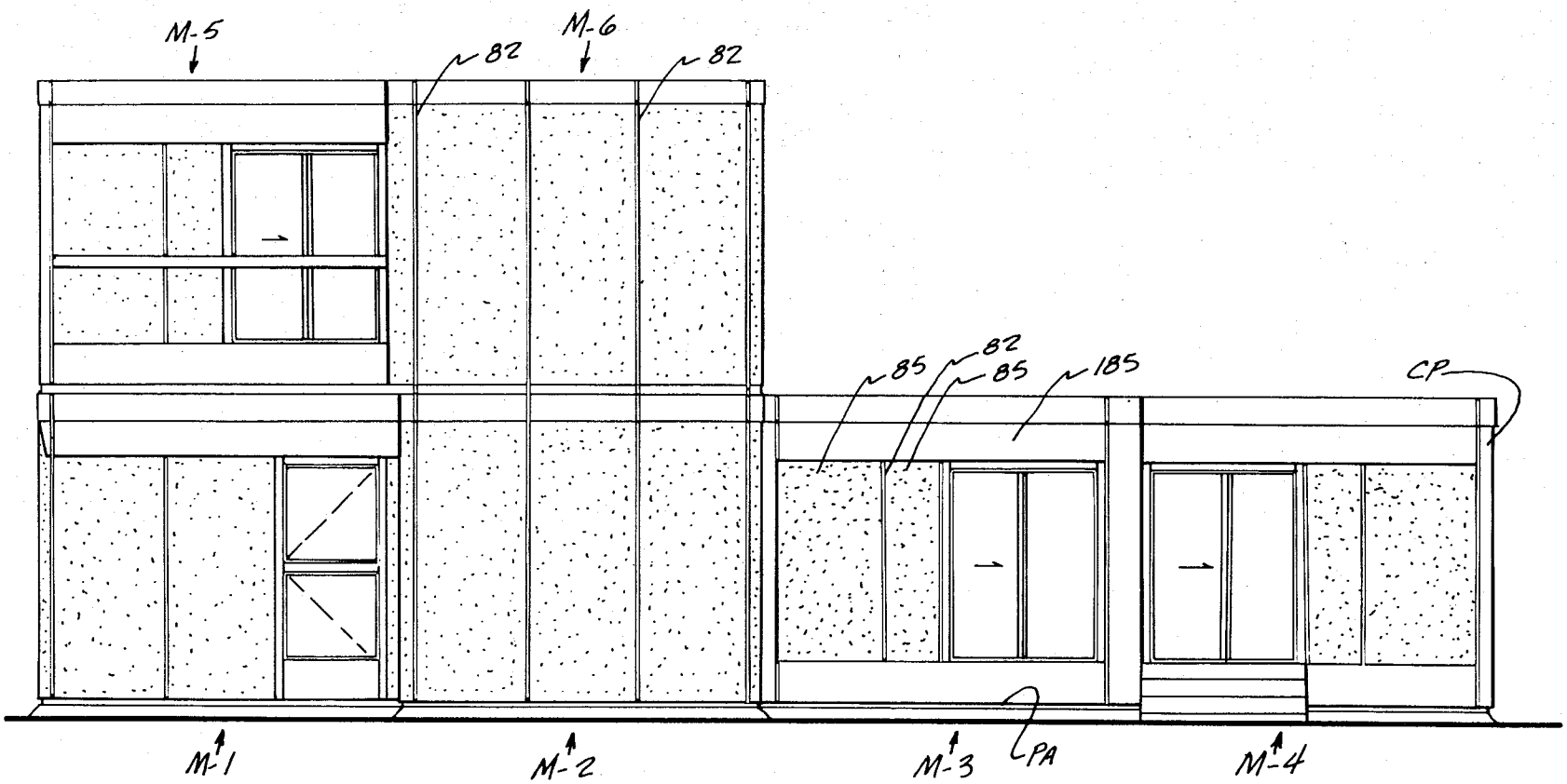
FIG. 5 is a rear elevational view of the building as illustrated in FIG. 4.
Figure 6:
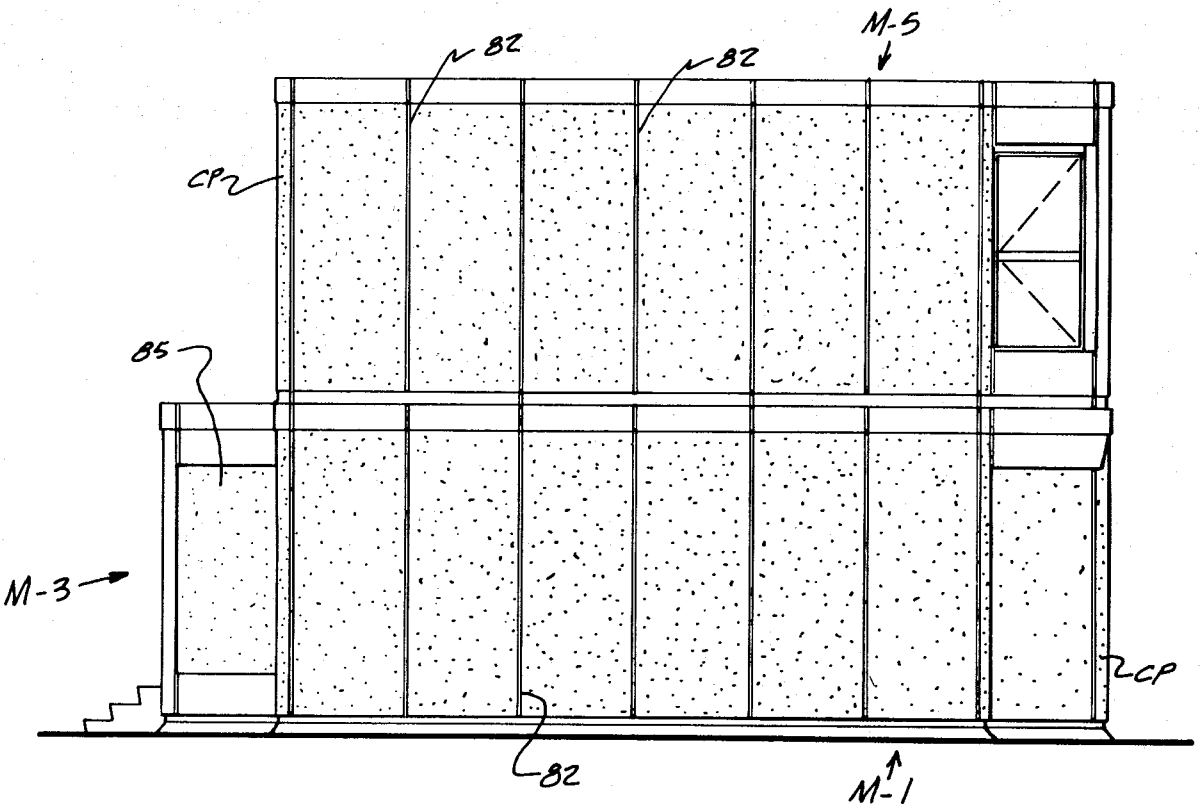
FIG. 6 is a side elevational view of the building as shown in FIGS. 4 and 5 viewed from a right hand side of FIG. 4.

As illustrated in FIGS. 3, 4, 5, and 6, corner panels CP may also be provided on the modules as well as other panels of various shapes and sizes as might be necessary to cover all intended surfaces of the module. Also, as shown in FIGS. 4, 5, and 6, the vertical joints 82 between the panels 85 may be quite visible. Plain panel 85 or an item receiving panel 185 may be manufactured with a corner section incorporated therewith, such that a continuous panel may be provided along a portion of one side of a module and extend at 90° around a corner of same. Similarly, as mentioned above, a texture may be produced in the outer surface of panels 85 and 185 to virtually conceal the vertical joints 82 between adjacent panels.

Composite Wall

Figure 13:
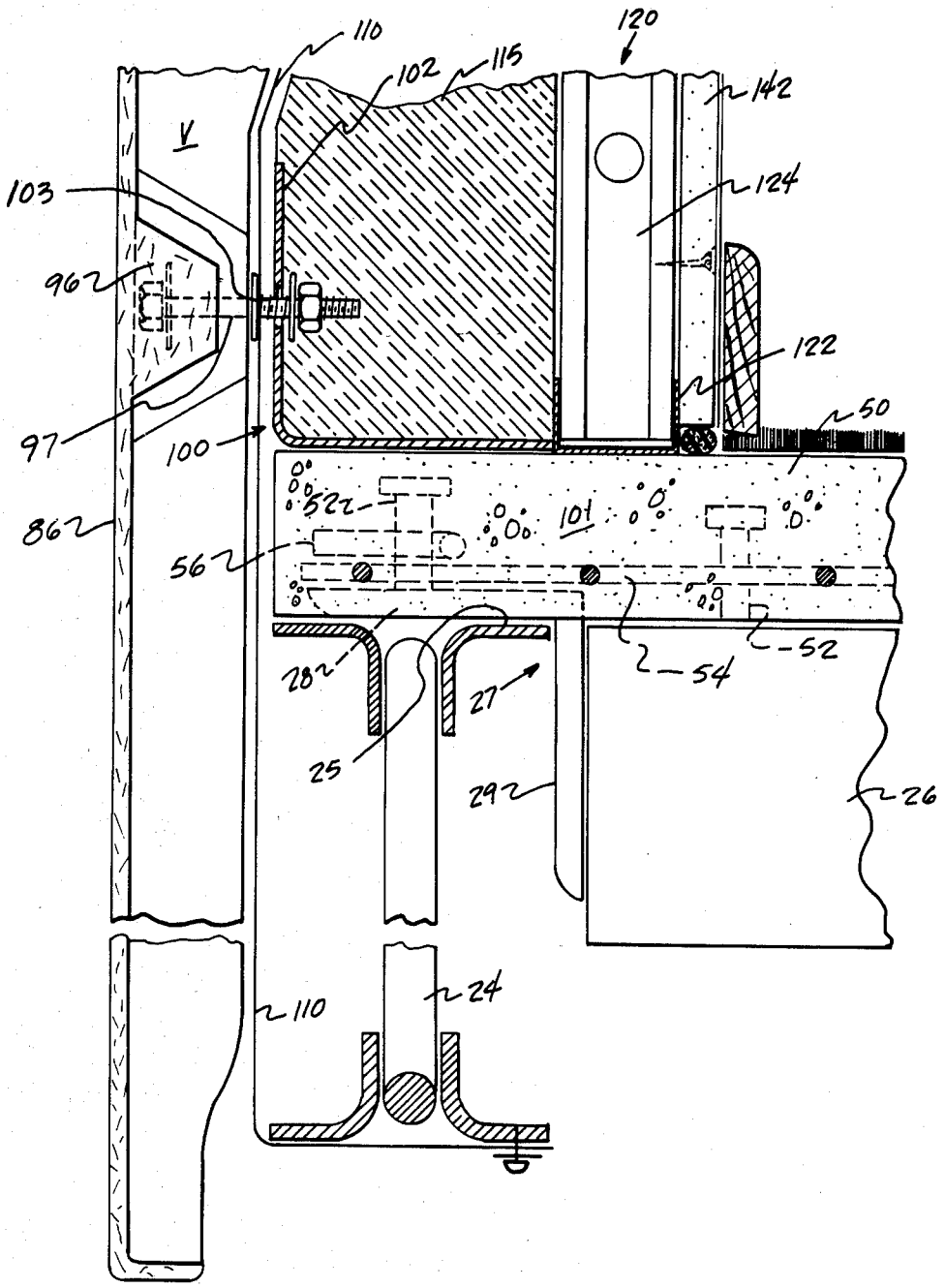
FIG. 13 is a vertical cross-sectional view of a portion of a composite wall of a module adjacent the floor taken generally along a line XIII—XIII of FIG. 3.
Figure 14:
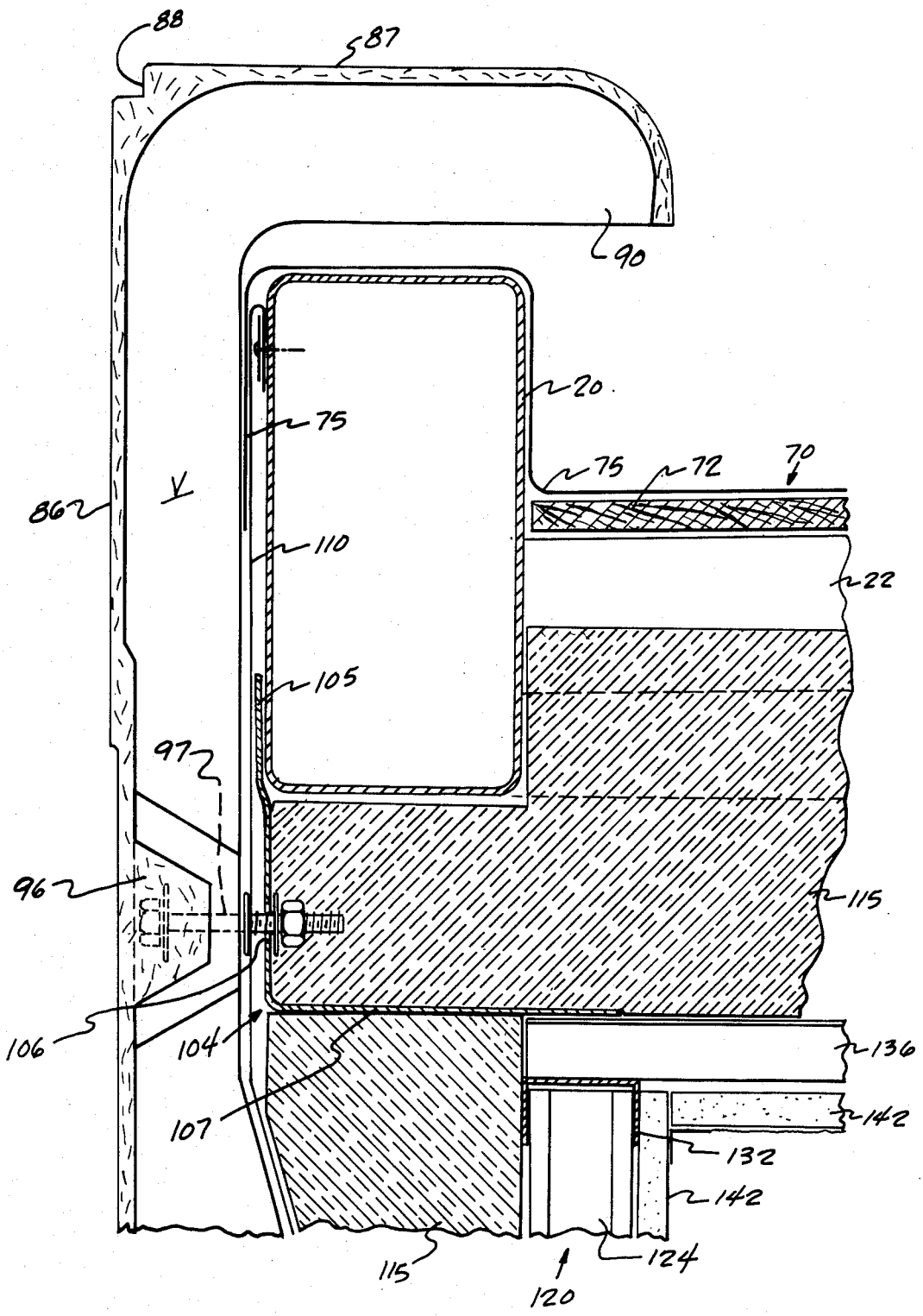
FIG. 14 is a vertical cross section of a portion of a composite wall of a module adjacent the roof taken generally along line XIV—XIV of FIG. 3.

A preferred composite wall is illustrated in FIGS. 13, 14, and **14*a*. In FIG. 13, one of the open web trusses 24 is illustrated having a floor beam 26 secured thereto by way of L-shaped connectors 27 and with the concrete floor 50 produced thereover. A panel mounting bracket generally 100 is secured to concrete floor 50 by bolts or the like (not shown) along a first leg 101 while an upstanding leg 102 is provided with a vertically extending slot 103 through which panel bolt connector 97 may be received. In similar fashion, as shown in FIG. 14, an L-shaped bracket 104 is secured along one leg 105 to one of the beams 20, 14, 36 or 39 at the upper portion of frame 10 and depends downwardly therefrom, having an elongated slot 106 therein beyond which a second leg 107 extends inwardly towards the interior of the module. The upper bolts or connectors 97 of panel 85 are received within opening 106 for securement of an upper portion of panel 85 to frame 10**.

Figure 14A:
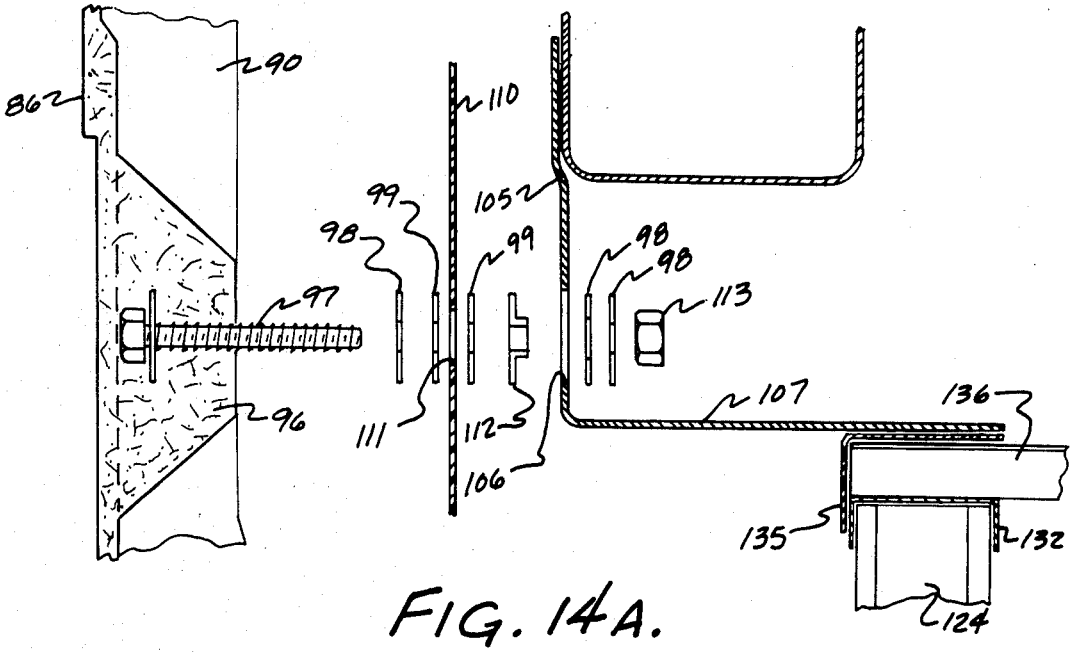
FIG. 14*a* is an exploded view of a connection between a cladding panel and a bracket as illustrated in FIG. 14.
Figure 15:
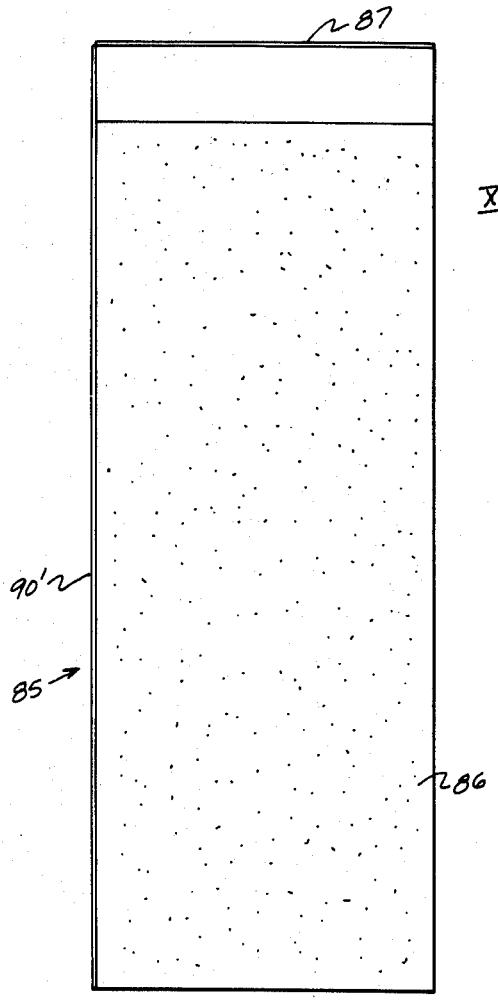
FIG. 15 is a plan view of an outer surface of a plane cladding panel according to teachings of the present invention.
Figure 16:
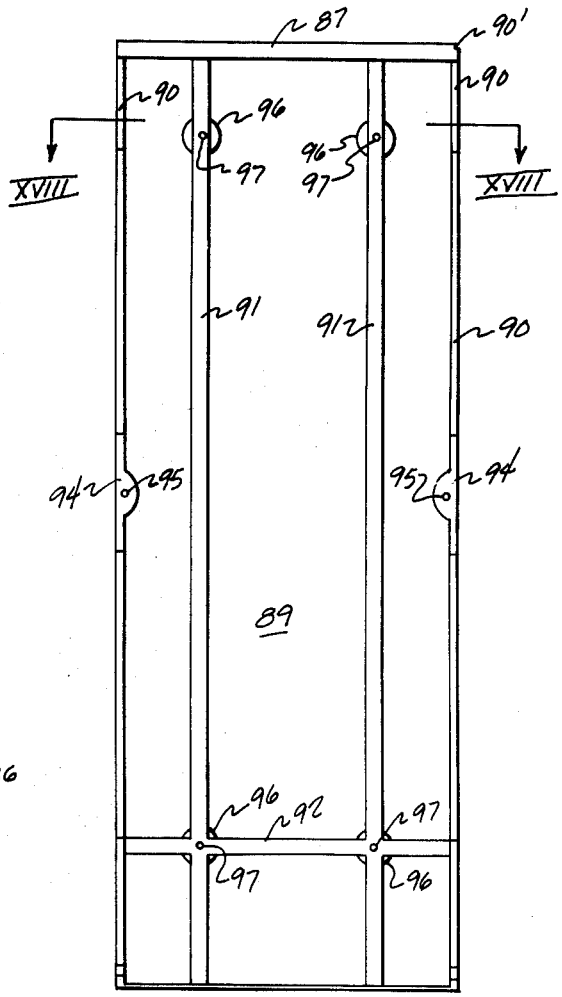
FIG. 16 is a plan view of an inner surface of a plane cladding panel according to teachings of the present invention.
Figure 18:
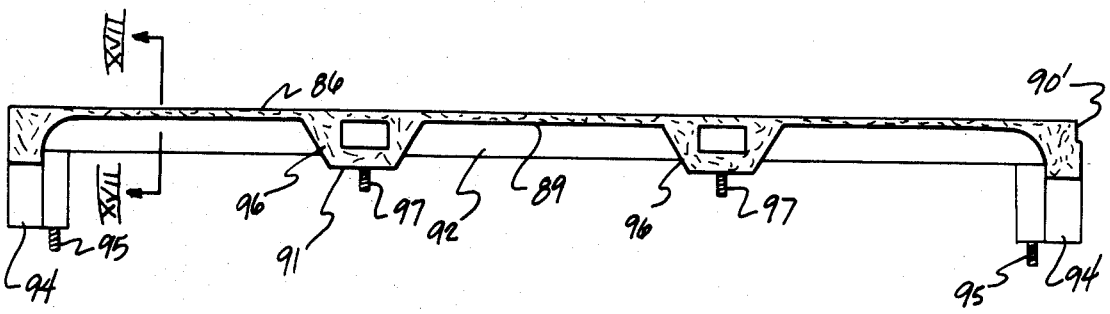
FIG. 18 is a cross-sectional view of a plane cladding panel according to teachings of the present invention taken along a line XVIII—XVIII of FIG. 16.
Figure 17:
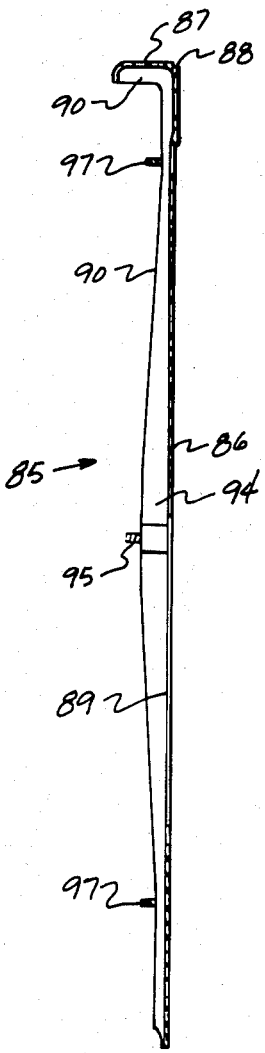
FIG. 17 is a vertical cross sectional view of a plane cladding panel taken along a line XVII—XVII of FIG. 18.

The general connection technique for panels 85 or the like to frame 10 is depicted in FIG. **14*a*, which would likewise apply specifically to the floor connection of FIG. 13. Vapor barrier 110 is located between panel 85 and frame 10 and is provided with an opening, preferably star shaped, at 111 to permit bolt 97 to pass therethrough. One or more washers 98 are received around bolt 97 adjacent pod 96. Resilient washers 99 are then placed on opposite sides of vapor barrier opening 111 with a collar washer 112 received thereabout. Two washers 98 and a nut 113 are received about bolt 97 inside of bracket 104. Such connection allows panel 85 to be secured to frame 10 while sealing opening 111 of barrier 110. Furthermore collar washer 112 precludes excessive tightening of bolt 97 against bracket 104, whereby bolt 97 may move vertically in bracket slot 106 if panel 85 should expand or contract due to thermal conditions. Also, bracket slots 103 (floor) and 106 permit vertical adjustment of panel 85 during installation. FIG. 14*a* also shows a stud runner 122 secured directly to a furring strip 136 which is in turn secured to an angle element 135 which is secured to brackets 104** along the length or width of the module, and thus represents an alternate embodiment for flexible stud wall attachment.

Making reference to FIGS. 3, 13 and 14, it is thus seen that the exterior panel 85 and thus wall 80 is secured in spaced apart relationship to frame 10, being respectively secured at a lower end to floor 50 and at an upper end to an upper beam. The continuous vapor barrier 110, exemplified by a fabric reinforced polyethylene sheet is secured at opposite ends as illustrated in FIGS. 13 and 14 to horizontal tubular element 20 at an upper end and to the bottom side of open web truss 24 at a lower end. Though not shown, vapor barrier 110 would be secured in similar fashion to the particular horizontal beams at the end of the module should a cladding wall 80 be located thereat. Vapor barrier 110, contrary to conventional construction techniques, is unsecured along intermediate portions of same. Enlarged peripheral rib sections 94 of panels 85 press inwardly against the vapor barrier 110 along the medial portion of same which holds barrier 110 taut between its upper and lower connections. Vapor barrier 110 and panels 85 thus define a passageway V therebetween which extends along the full length of the module. Moreover, since inturned flange 87 of panel 85 extends upwardly and inwardly of elongated column 20, and likewise of the transverse beams at the ends of the module, passageway V extends from roof 70 of the module downwardly along all exterior side walls and provides both a ventilating passageway V, and as described hereinafter, water overflow passageway from roof 70. Accordingly, particularly in hot climates, the ventilating passageway V acts as a thermal barrier against ingress of heat generated on wall 80 from direct sunlight.

Internally of the vapor barrier and generally along the vertical plane of the horizontal frame elements, appropriate insulation material 115 is received. An interior, non-load bearing wall generally indicated as 120 is located internally of frame 10 and insulation 115. Wall 120 typically includes stud receiving elements such as bottom stud runners 122 secured to the concrete floor 50 (FIG. 13) with conventional wall studs 124 secured therein and extending upwardly therefrom. Referring now to FIG. 14, it is noted that leg 107 of L-shaped bracket 104, which has some degree of flexibility, extends inwardly of frame 10 with ceiling insulation 115 received thereabove. Upper stud receiving elements such as stud runners 132 are secured to a support such as a furring strip 136 with an upper end of wall stud 124 secured therein. The ceiling grid 130 is comprised of a plurality of such crossing furring strips 136, the outer periphery of same being secured in like fashion to a leg 107 of an L-shaped or other type bracket 104, or to an angle element 135 as shown in FIG. 14*a*. Likewise, all of the upper stud runners 132 may be secured to the grid structure whether the stud wall is a peripheral wall or an internal partition wall. Accordingly, as described with respect to FIGS. 13, 14 and 14*a*, all wall studs 124 utilized in fabrication of interior walls of the module according to the present invention, are rigidly secured at the floor level while being flexibly secured at an upper end of same, the flex being afforded by the free end of the leg 107 or a similar type bracket. Such a feature is important for the following reasons. As will be described hereinafter, the roof 70 for the module according to a preferred aspect of the present invention is plywood covered with a waterproof material, and thus much lighter and less rigid than concrete floor 50. During transit of the module from the factory to the building site harmonic vibrations of different amplitudes are set up in the floor and roof, respectively. Hence, should the wall studs be rigidly secured at both ends, forces applied thereto are generally adequate to rip same from their securement. Such of course would destroy the integrity of the interior walls of the module and likewise would likely cause damage to the interior decorative surfaces. Securing the upper ends of the stud walls in the flexible fashion noted above solves such a problem. Studs 124 of peripheral interior walls may also be secured intermediate their length to a Z bar or the like 125 which is secured to panels 85 at the points of lateral connection between same (See FIGS. 22 and 24).

Figure 22:
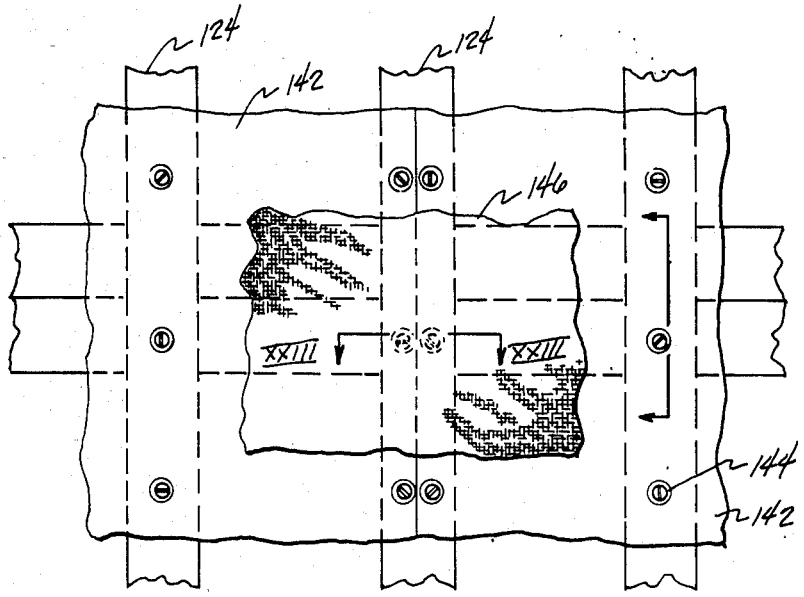
FIG. 22 is a partial plan view of an interior wall structure of a module according to teachings of the present invention.
Figure 23:
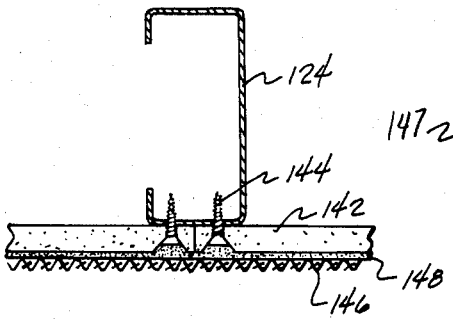
FIG. 23 is a horizontal cross-sectional view of a portion of FIG. 22 taken along a line XXIII—XXIII.
Figure 24:
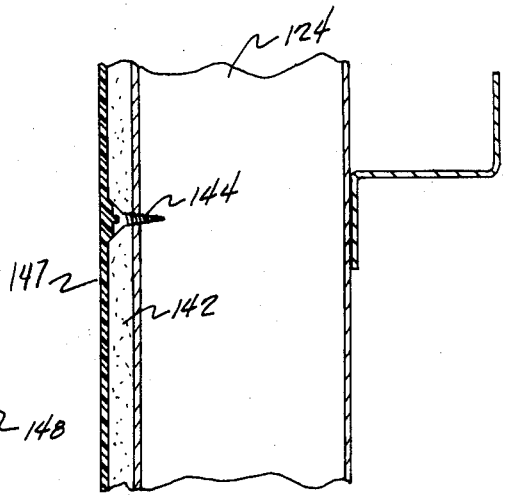
FIG. 24 is a partial horizontal cross sectional view in similar fashion to the cross sectional view of FIG. 23, but illustrating a further embodiment of the present invention.

With the interior stud walls located as desired, whether around the interior of frame 10 or as internal partition walls, suitable interior wall surfaces or elements 140 may be secured thereto. According to a preferred aspect of the present invention, such interior wall surfaces are gypsum board panels 142 which are conventionally employed in sheets 4 feet wide and 8 feet long. The sheets 142 of gypsum board are secured to the wall studs by appropriate fasteners such as self-threading screws (See FIGS. 22 to 24) which screws 144 are countersunk within the gypsum board. Heretofore, it has often not been possible to utilize gypsum board panels in such factory built structures intended to be transported to a building site for erection, particularly for distances of more than 100 miles. Due to structure of the gypsum board, stresses applied on same can cause fractures in the board. Likewise the nails, screws or the like used to secure the panels to stud walls become loosened due to vibration developed during extended transit, thereby loosening the gypsum board. A loose gypsum board panel abets fracture of same and at the same time yields an aestheticly undesirable condition. Generally for module transit of short distances, say 100 miles or less, it may not be necessary to reinforce the gypsum board panels. At greater distances, reinforcement of the panels is important, however, and is described below. According to the present invention, as is best shown in FIGS. 22 to 24, once the gypsum board panels 142 are attached to the stud walls 120, preferably with self-threading screws 144, a covering 146 is applied across panels 142 and the joints between same. Suitable coverings 146 both reinforce the panel 142 and secure screws 144 against loosening. Exemplary of a suitable covering 146 is a strong fabric, such as a fiberglass fabric that is secured across the entire face of the gypsum board panels, including the joints produced between same, by way of an adhesive 148 (See FIG. 23). Thereafter, fabric 146 may be appropriately painted, papered or the like, if desired. A woven fiberglass fabric, per se, is a preferred covering 146, however, since an interesting decorative texture is afforded thereby.

An alternative exemplary protective covering 147 is illustrated in FIG. 24. As shown, a gypsum board panel 142 is secured to stud 124 by an appropriate self-threading screw 144 or the like. A self-curing polymer coating 147 is applied across the surface of gypsum board panels 142 and the joints therebetween. Once the polymer coating cures, a continuous flexible polymer film 147 covers the entire panel surface which stabilizes the panels 142, per se, and likewise fills the countersunk areas in which the screws 144 are received to lock same against withdrawal. While any suitable polymer coating may be utilized that will produce a proper continuous and flexible film across the gypsum board panels and joints therebetween, a preferred coating is a polymer emulsion of acrylic and methacrylic acid. Exemplary of such product is Rubson "Special Frontage" manufactured by Rubson SAF, 7, Rue Lionel-Terray, B.P. 215, 92502, Rueil-Malmaison CEDEX, France. Such polymer coating may be rolled or otherwise applied onto the gypsum panels, and when dried forms a continuous flexible coating across the overall panel surface and joints, which is washable, waterproof, and even contains a fungicide which prevents the growth of mildew. Polymer coating 147 may contain particular colorants, as desired.

Utilizing a composite module wall structure as identified immediately above, an important aspect of the present invention becomes apparent. Particularly, all known prior art transportable modular systems that have utilized a load bearing structural frame to which exterior and interior walls are secured, have utilized a structure perhaps out of necessity, in which a portion of the frame is either exposed or protrudes externally or internally of the module. Exposed or protruding frame elements can create both aesthetic and architectural design problems. Most importantly, internal protruding frame elements limits the internal design capabilities for the interior space within the module, and generally require the "cubic" design. Modules of the present invention, however, are not so restricted since no frame elements are visible and none protrude into the interior modular space. In fact, no further internal supports are normally necessary, thus providing a totally open internal space area that may continue indefinitely by the addition of modules. Certain load requirements, exemplified by vertically stacked modules may dictate a need for diagonal braces 17 along one or more walls, secured between the upper and lower horizontal elements of frame 10 (See FIG. 9).

Roof System

Making reference to FIGS. 2, 3, 14, 21 and 27, a preferred roof system for modules according to the present invention will be described. As shown in FIG. 3, and as mentioned hereinbefore, elongated tubular columns 20 of the structural frame 10 coupled with the transverse portal frame beams 14, and if appropriate, the elongated and transverse beams 36 and 39 of cantilever sections 30 define the perimeter of the roof section of the module, with roof purlins 22 extending across the module in the transverse direction. Roof purlins 22 are secured on one side of frame 10 to the tubular members 20 or 36 at the same general height along the length of the module while along an opposite side of the frame, purlins 22 are secured at predetermined lower levels, defining a particular slope across the width of the module for each purlin 22.

Figure 21:
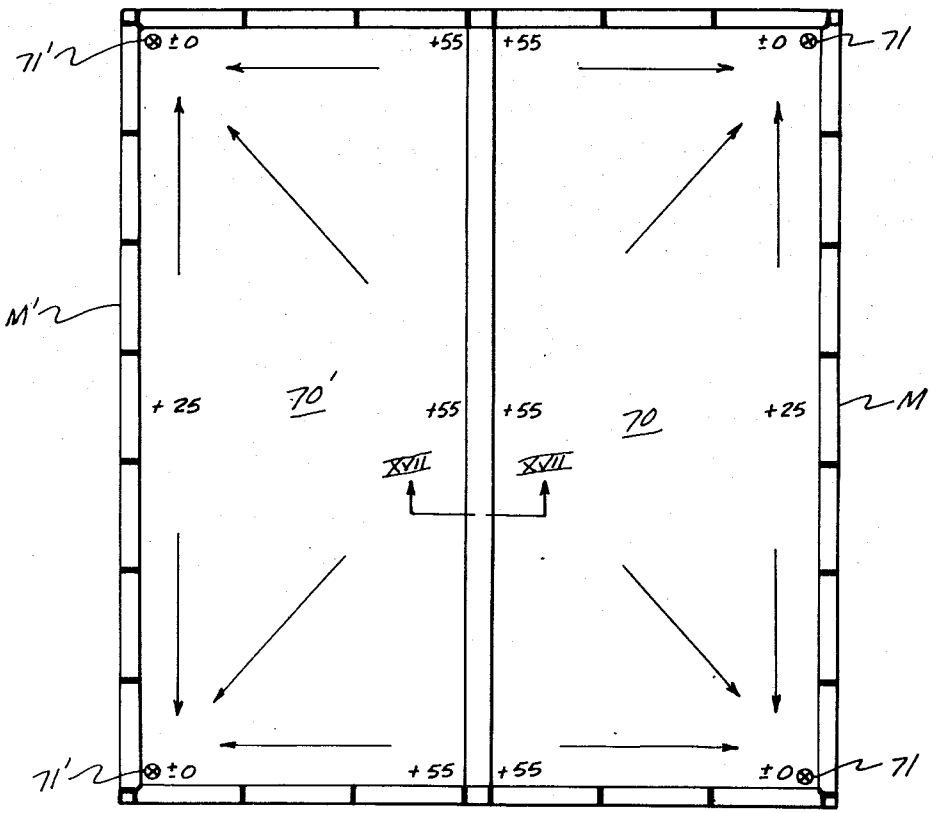
FIG. 21 is a plan view of a composite roof of a two module cluster according to teachings of the present invention.

As is illustrated in FIG. 21, two modules M and M' are located side by side such that the roofs 70, 70' of the modules slope from the junction between same outwardly toward opposite corners of the roofs, according to the arrows. With such arrangement, as can be seen by the numerical indications of deviation from planarity, purlins 22 are secured at a common level along the junction side of the modules, whereas all purlins 22 slope downwardly toward the opposite side of frame 10 with the slope increasing from a middle of the modules (+25) in opposite directions therefrom to the outer corners (±o) at which point downspouts 71, 71' are located to drain water from roofs 70 and 70'. Specifically referring to FIG. 14, it can be seen that roof purlin 22 secured to tubular element 20 is sloped in the direction of element 20 in accordance with the overall roof slope as mentioned above.

Planar sheets of a roof material 72, such as a marine grade plywood or the like are secured to the purlins 22 (See FIGS. 3 and 14) by self-threading screws or the like to define a sub-roof over the intended roof area of the module. Each sheet 72 should be secured to purlins 22 at adequate locations thereacross to ensure proper rigidity to the structure as well as integrity of the roof. As shown in FIG. 3, if desirable, brackets 73 may be secured to beam 20, etc. between purlins 22 affording further peripheral securement sites for roof panels 72. Also, since beams 14 of portal frame 11 are horizontal, a wedge 23 of wood or the like (See FIG. 3) may be received atop beams 14 to provide continuation of the slope of purlins 22. Furthermore, individual panels 72 are preferably adhesively or otherwise secured along the joints 74 therebetween to form a unified subroof structure for the module. A continuous waterproof covering 75, such as an appropriate polymer film is secured to subroof panels 72 by way of adhesive, thermal or sonic welding or the like. Should sheets of waterproof film 75 be utilized, the individual sheets may be heat sealed at overlying junctions to provide a continuity to barrier 75 across the entire area of roof 70. As can be seen in FIG. 14, waterproof barrier 75 not only extends across the area of the module covered by the subroof panels 72, but extends upwardly and around the peripheral frame elements (only tubular element 20 is shown) and is secured in ventilating passageway V, generally to vapor barrier 110. As seen in FIGS. 2 and 3, upper horizontal elements of the portal frames and of cantilever sections 30 are at a lower level than beams 20. Further members such as wooden timbers 79 (FIG. 3) may be placed atop panels 72 to define a barrier over which water may flow. Waterproof barrier 75 would then be received over members 79 and pass downwardly into passageway V. Members 79 can be varied in height to determine the point of overflow from roof 70, and in fact could define notches or the like along the length of same for such purpose.

As illustrated in FIGS. 3, 14 and 21, inturned flanges 87 of cladding panels 85 extend above and inwardly of the frame 10, forming a parapet around roof 70. Should downspouts 71 or 71' become clogged or have inadequate capacity for removing water collected on roof 70, water can overflow into the ventilating passageway V and exit at a lower end of the module.

Figure 27:
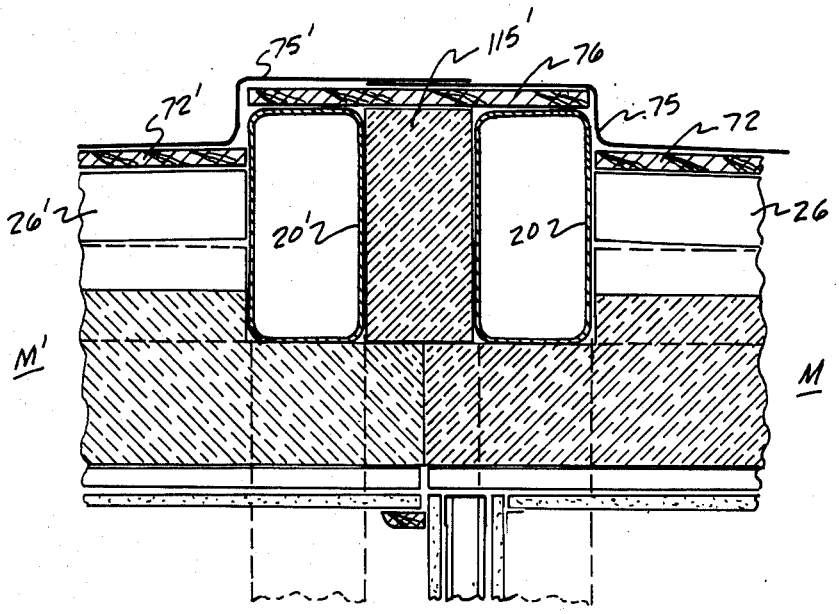
FIG. 27 is a partial vertical cross-sectional view of a roof connection as would be taken along a line XXVII—XXVII of FIG. 21.

Making reference to FIGS. 21 and 27, when two modules M, M' are placed side by side, appropriate connection must be made to achieve a unified roof 70, 70'. When module M and M' are properly positioned, tubular elements 20 and 20', respectively, are juxtaposed along the lengths of modules M, M', leaving a small gap therebetween. In order to unify the roof structure at the junction of the modules, a further, smaller panel 76 is secured to the tubular elements 20 and 20' and covers the gap therebetween. Segments of waterproof barrier 75 and 75' from the modules M, M' are laid across panel 76 and secured thereat to define a continuous waterproof barrier across the junction between the modules. If desired, additional insulating material 115' may be provided in the junction gap.

While a generally planar roof has been described, obviously a gabled or other type roof, or a portion of same may be secured to a module. Such further roof may be in addition to or in lieu of a planar roof as described above.

Composite Modular Structures

As can be gleaned from the above descriptions of modules according to the present invention, a plurality of such modules may be assembled into a composite building structure which is devoid of the normal "cubic" restrictions of the prior art. Interference or restriction due to protruding or intermediate internal structural elements is normally avoided, and once the structure is completed on site and properly finished, it is generally indistinguishable from conventional "stick built" structures.

Figure 9:
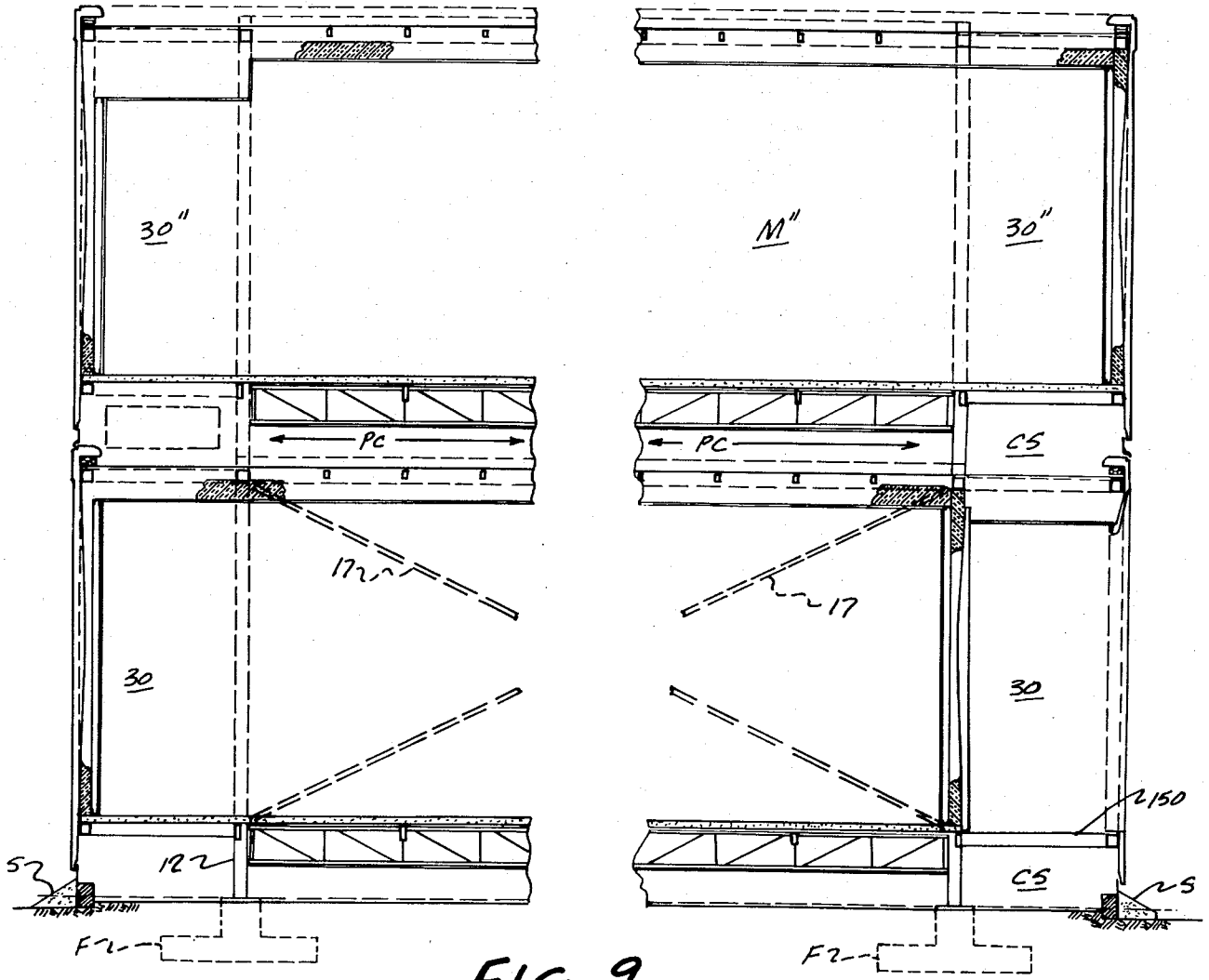
FIG. 9 is a skeletal side or longitudinal view of two vertically stacked modules.
Figure 10:
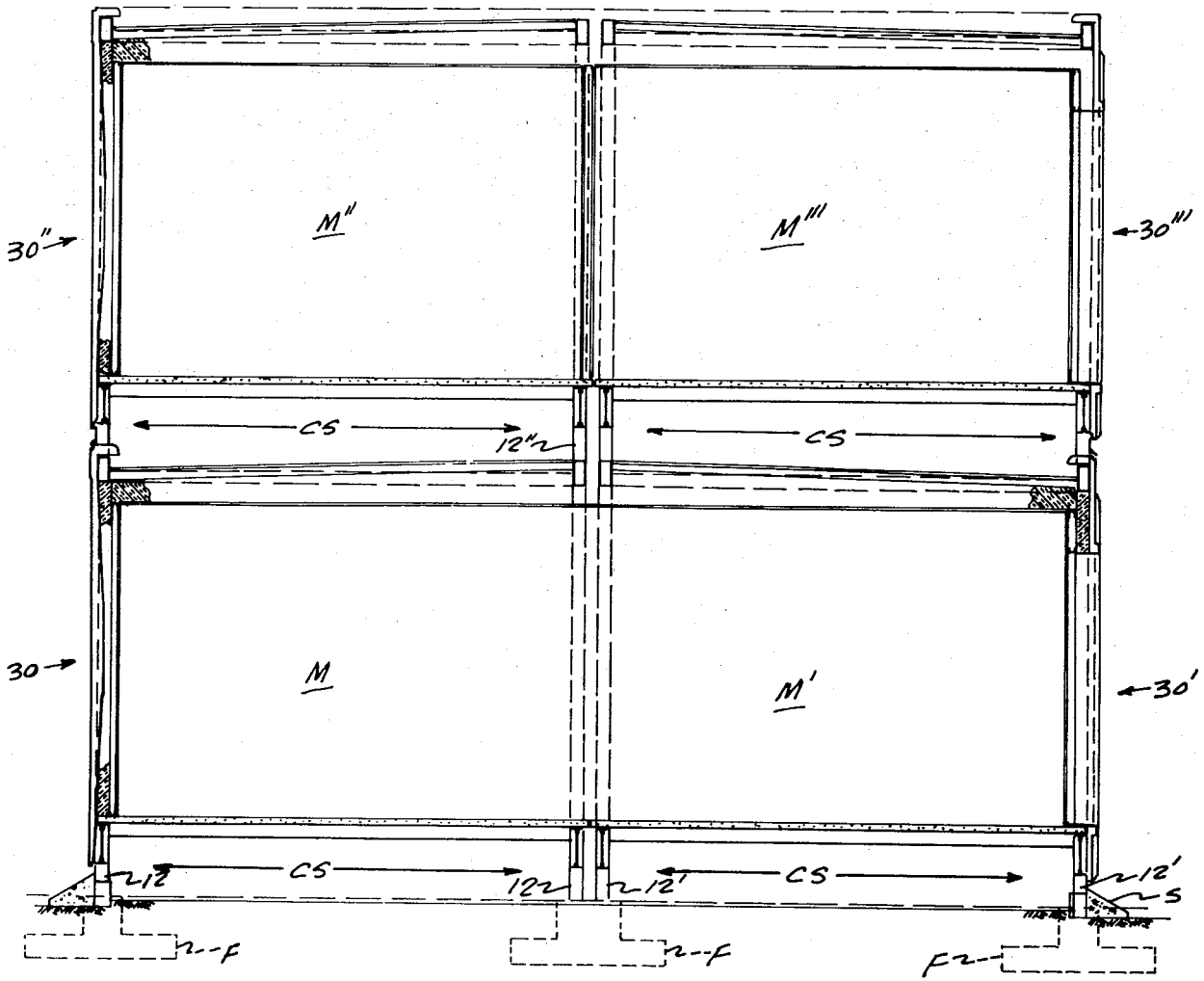
FIG. 10 is a skeletal end view of the stacked modules of FIG. 9.
Figure 11:
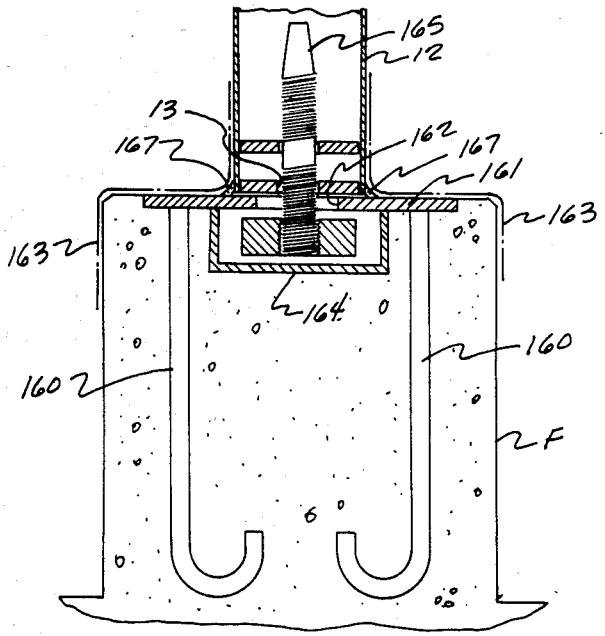
FIG. 11 is a partial cross-sectional view of a vertical column of a portal frame secured to a foundation pod according to teachings of the present invention.
Figure 29:
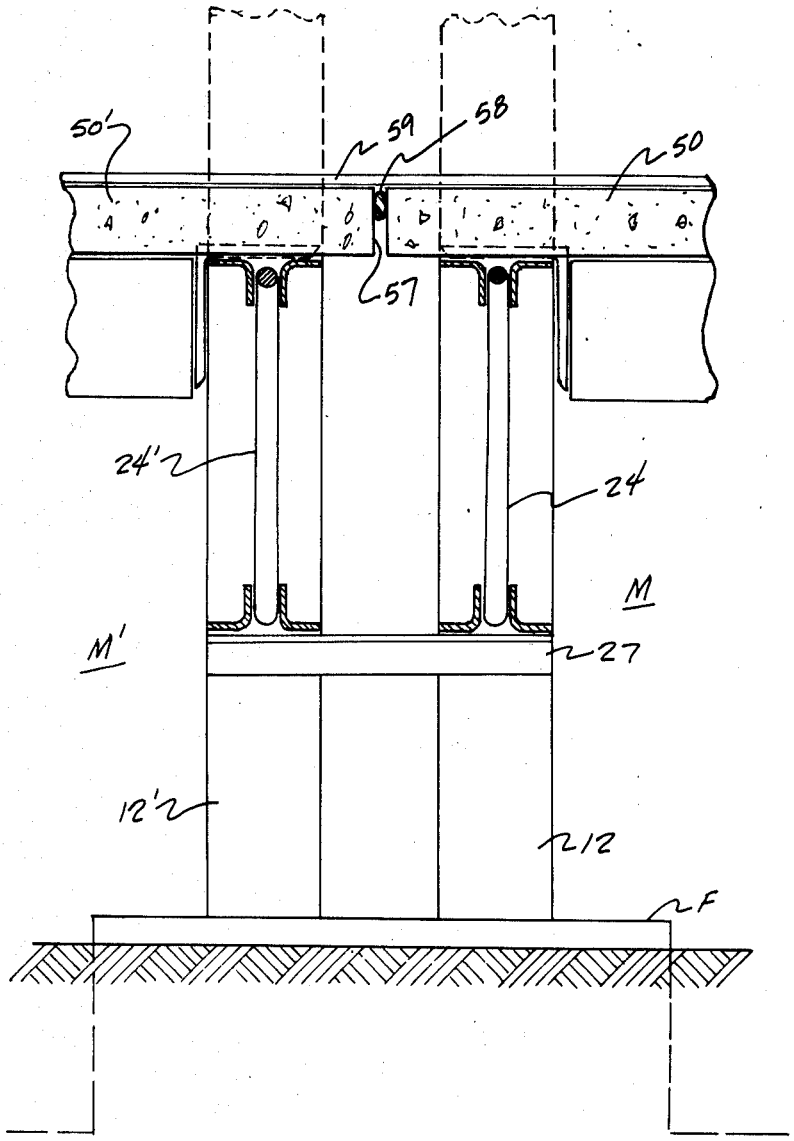
FIG. 29 is a partial vertical cross-sectional view of the juncture between two adjacent modules as would be taken along a line XXIX—XXIX of FIG. 7.

Making reference to the Figures, placement and coordination of modules to form a composite structure will now be explained. FIGS. 9, 10 and 11 illustrate a preferred method of placement of modules at the building site. Foundation footings or pads F are positioned coincident with portal frame columns 12 to be received thereon. Foundation footings F preferably include reinforcement exemplified by a pair of J bolts 160 secured to a base plate 161 having a slot 162 therein. Base plate 161 resides atop footing F with J bolts 160 encapsulated within footing F. A housing 164 is located on an underside of plate 161, within footing F, having an anchor bolt 185 loosely receiveable therein and protruding upwardly therefrom through slot 162. Portal frame columns 12 are received on plates 161 with anchor bolts 165 passing into receiving openings 13. Plates 161 serve as bearing surfaces on which the weight of the module is supported by columns 12. Furthermore, due to the potential inaccuracies in location of footings F, slot 162 permits lateral adjustment of anchor bolts 165 such that the final adjustment of the module onto four such footings F is permissible in the field. Once the module rests on its footings F, each of which is positioned to receive a portal frame column 12 thereover, with the anchor bolts 165 properly extending upwardly into same, the module may be secured in place by weldments 167 at the junction of a lower end of column 12 and an upper surface of plate 161. A bitumen coating or the like 168 may be applied along a lower end of columns 12 and across the upper surface of footings F to seal same. As illustrated in FIGS. 10 and 29, a single footing F may be utilized to receive columns 12, 12' of two adjacent modules M, M'. Such an arrangement requires two anchor bolt assemblies in a single bearing plate, or two independent bearing plate assemblies.

Figure 12:
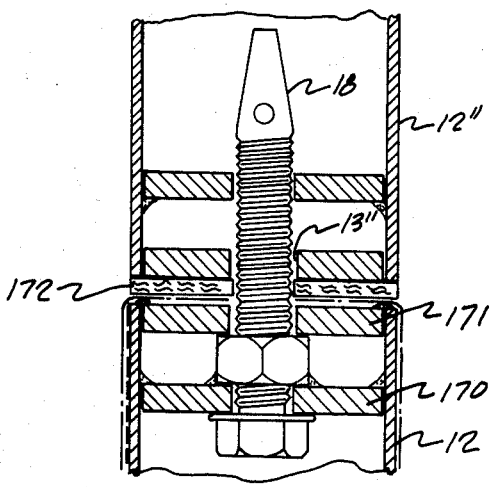
FIG. 12 is a cross-sectional view of the interface between two portal frame columns to illustrate the connection between upper and lower vertically stacked modules.

FIGS. 9, 10 and 12 illustrate an appropriate arrangement for vertical stacking of modules one atop the other. In fact, though only a two story structure is shown and described herein, at least one additional story may be added with like connections as occur between modules of a first and second story. As stated above, each portal frame column 12 is provided with a connector pin 18 that is secured to same and extends outwardly therefrom. In FIG. 12, a preferred arrangement for securement of connector pins 18 is illustrated. A threaded pin 18 is shown lockingly secured to a plate 170 located within column 12 and extending through an apertured plate 171 beyond the end of column 12. With a first module M properly positioned on its footings F, a second module M' may be placed atop first module M, locating tubular columns 12'' of module M'' such that connector pins 18 from lower column 12 are received within the connector pin receiving opening 13'' of portal frame columns 12'' of an uppermost module M''. A resilient gasket 172 is receivable between the portal frame columns of the upper and lower modules, is compressed by the weight of module M'' and aids in stabilizing the connection.

No further structural connection is needed for vertically stacked modules for the weight of the upper module M'' is adequate to ensure that same remains in place without movement, even in earthquakes, storms or the like. Further, where connector pins 18 are received in openings 13'' of an upper module M'', alignment of the upper module M'' with respect to the lower module M is automatically achieved.

Vertically stacked modules according to the present invention present a number of features noteworthy of mention. For example, in FIGS. 9 and 10, modules M, M', M'' and M''' are all of the cantilevered type, including cantilevered sections 30, 30', 30'', and 30''' at opposite ends of the module. A plenum chamber PC is provided between the floor of a module and the ground or a module roof therebelow whichever is the case. As can be seen in FIG. 9 viewing the length of modules M and M', whereas the vertical space in plenum chambers PC, between the ground and truss 24 and between the roof 70 of module M and truss 24'' is inadequate for passage of a human therebetween, there is adequate vertical space for a crawl space CS which extends across the width of the cantilever sections structure (See FIG. 10). Between trusses 24 of an individual module M, M'', or the like, no such restriction is present along the length of plenum chamber PC (See FIG. 10), whereby there is adequate space for human passage fully therealong. Accordingly, when repairs, maintenance or the like is required, maintenance personnel may pass through crawl space CS across the width of a plurality of modules and along an individual plenum chamber PC longitudinally of a module to perform the intended services. Though not shown, when such crawl spaces are provided, it is preferred that an access panel be provided at some exterior point in alignment therewith, which panel may be easily removed affording access to the interior of the structure. One desirable approach as illustrated in FIG. 9 is to run duct work 29 (shown in phantom) beneath one cantilever section while leaving the opposite cantilever section free for use as a crawl space CS as defined above. With this particular arrangement, adequate space is provided throughout any composite structure to facilitate the inclusion of all conduit, cable, duct work or the like as would be necessary, while at the same time, as opposed to prior art structures, retaining ready access thereto.

As further illustrated in FIGS. 9 and 10, the perimeter around the module structure may be provided with suitable materials S of any desired form to basically enclose or underpin the space between the lowermost module M and the ground surface.

Figure 25A:
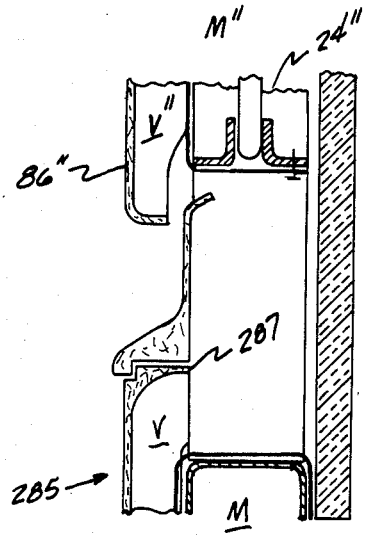
FIG. 25*a* is a partial vertical cross-sectional view taken along a same line as FIG. 25, but illustrating a further embodiment of the present invention.
Figure 25:
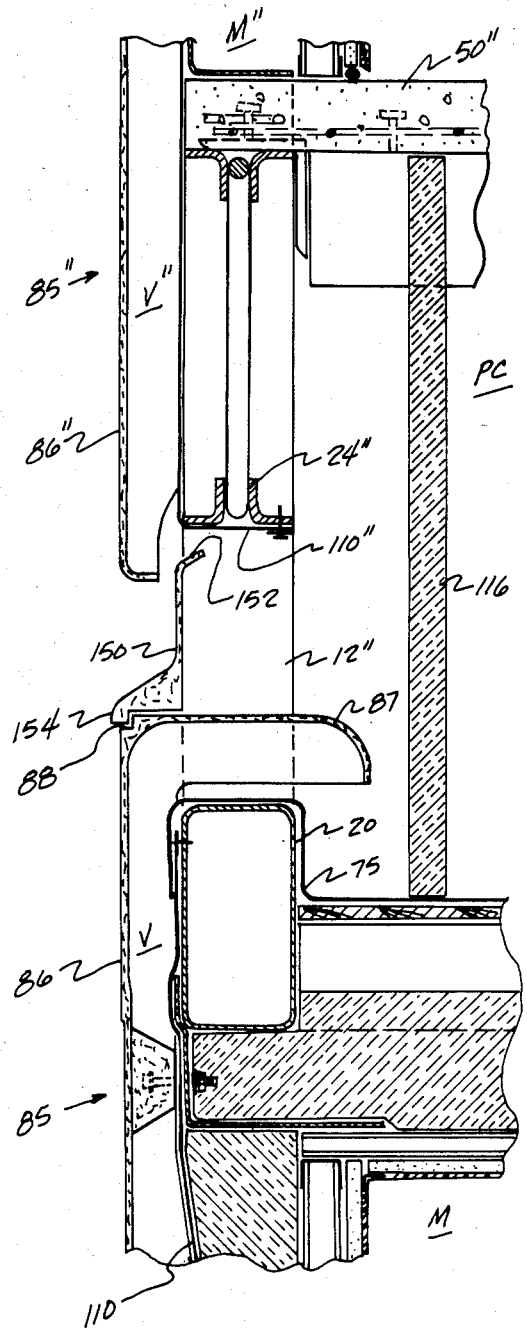
FIG. 25 is a partial vertical cross-sectional view of a portion of the composite side walls of a pair of vertically stacked modules according to the present invention as would appear along a line XXV—XXV of FIG. 9.

The ventilation passageway V located inside the exterior walls 80 along the height of the module is also readily available along the total height of vertically stacked modules. Hence in FIGS. 9 and 10, a ventilating passageway V would be provided along the entire height of the structure, as well as providing the water overflow capability from the roof and from the plenum chamber PC between modules M and M''. Particularly, such is illustrated in FIGS. 25 and 25*a*. Cladding panel 85 of module M is secured to a beam 20 with inturned flange portion 87 extending upwardly and inwardly of same, whereby ventilating passageway V as defined above is provided along the height of same. In like fashion, ventilating passageway V'' is provided along the height of module M''. With module M'' positioned atop module M, plenum chamber PC is defined therebetween. As can be seen from FIG. 25, cladding panel 85'' of module M'' does not extend downwardly an adequate distance below floor 50'' to meet panel 85 of lower module M and thus close plenum chamber PC. A facia panel 150 is located therebetween to mask the open space between panels 85 and 85''. Facia panel 150 has an upper inturned flange portion 152 that extends inwardly beneath truss 24'' of module M'' and thus inwardly of vapor barrier 110'', such that water overflow from the roof (not shown) of module M" would pass through ventilating passageway V", onto facia plate 150 and be diverted outside of the structure. Facia plate 150 though extending upwardly beyond the lower edge of panel 85" is spaced apart from same, thus permitting air flow from ventilating passageway V" around facia plate 150 into ventilating passageway V and thus providing ventilation along the height of the building structure. A layer of insulation material 116 is provided across the open end of plenum chamber PC to properly insulate same. Facia plate 150 has a lower lip 154 that mates with panel upper notch 88 and is secured to panel 85 by a self-threading screw or the like (not shown).

While the arrangement as shown in FIG. 25 functions properly, such is primarily utilized where the panels 85 were intended for single story modules. Where, however, it is predetermined that a multi-story unit is to be fabricated, an arrangement as illustrated in FIG. 25*a* is preferred for same. Particularly, the structure shown in FIG. 25*a* is the same as shown in FIG. 25 with the exception that the inturned flange 287 of cladding panel 285 of module M is shorter in length than the inturned flange 87 as illustrated in FIG. 25. A less tortuous route is thus provided between passageways V" to V of modules M and M" without sacrifice of any of the other characteristics.

Typical Building Structure

Making reference to FIGS. 4–8, 21, 26 and 29 an exemplary structure according to teachings of the present invention is illustrated. A first module M-1 is provided having a cantilevered section at a rear end of same (See FIGS. 4 and 7) and includes a garage, a workshop at the rear of the garage and a back porch. The monolithic reinforced floor of the module will support an automobile, thus demonstrating the strength of the floor, though same would be raised above ground level. A preferred arrangement, however, for a garage module is to exclude the floor, and pour a concrete slab at ground level. In such instance, obviously floor purlins 26 would be omitted. Likewise trusses 24 may be replaced with tubular beams 20, though same may require further support intermediate the length of same. Module M-1, like the rest of the first floor modules to be described hereinafter is supported by foundation footings F as described hereinbefore, with appropriate materials received about the base of same to enclose the space around the first floor units. Adjacent module M-1 is module M-2 which is cantilevered at both ends, (See FIG. 7), with the cantilever at the front end of the module serving as an entrance way to the house and the cantilever at an opposite end of the module housing a portion of the kitchen. Modules M-3 and M-4 are located adjacent module M-2 with both having single cantilever sections off the rear of same, cooperating to define a patio PA. Top story modules M-5 and M-6 are set atop modules M-1 and M-2 respectively, as described hereinabove with respect to FIGS. 9, 10 and 11, and contain the living quarters (FIG. 8) along with a balcony B off the master bedroom.

Figure 7:
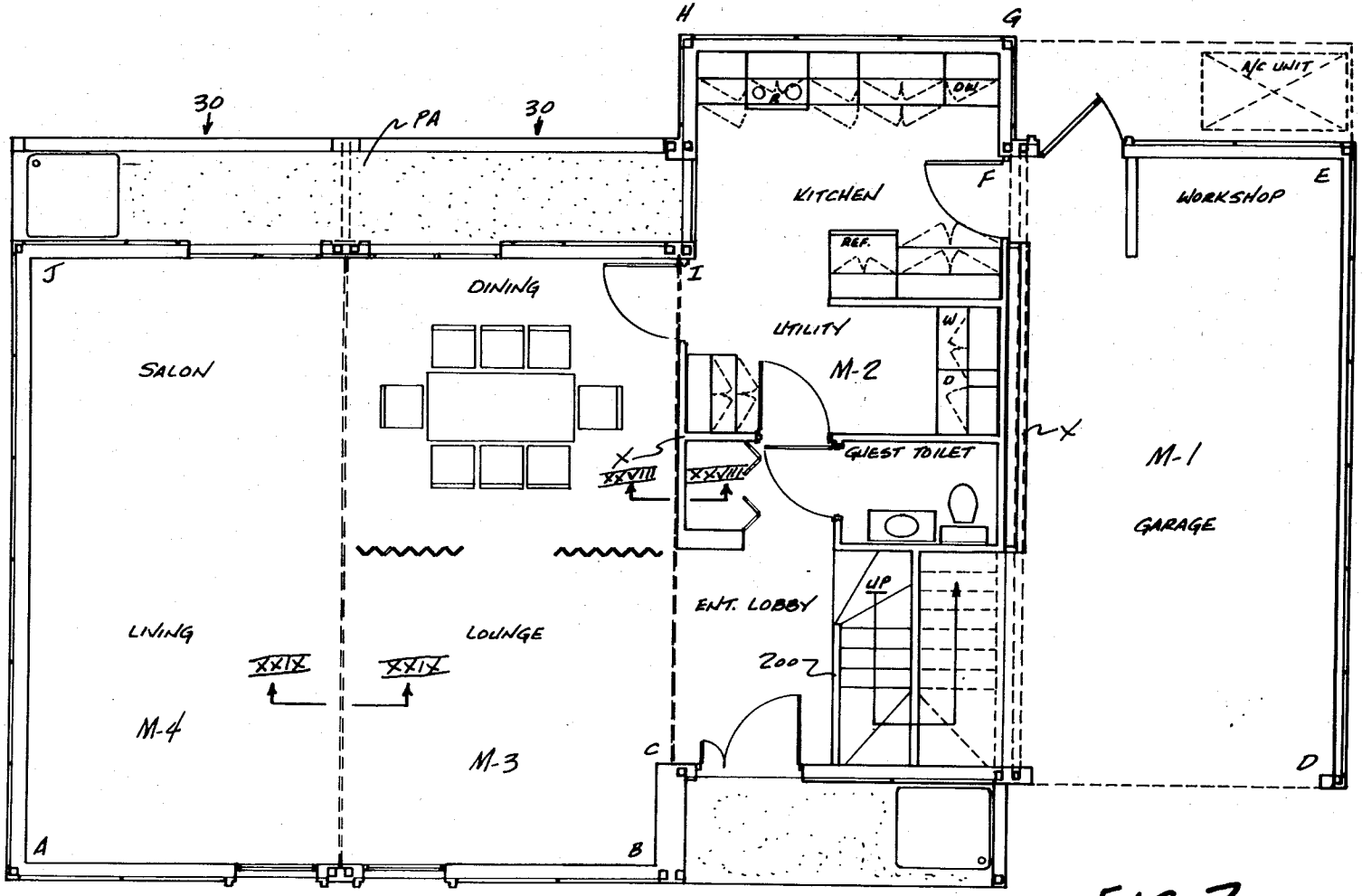
FIG. 7 is a floor plan of the first floor of the building illustrated in FIGS. 4–6.
Figure 8:
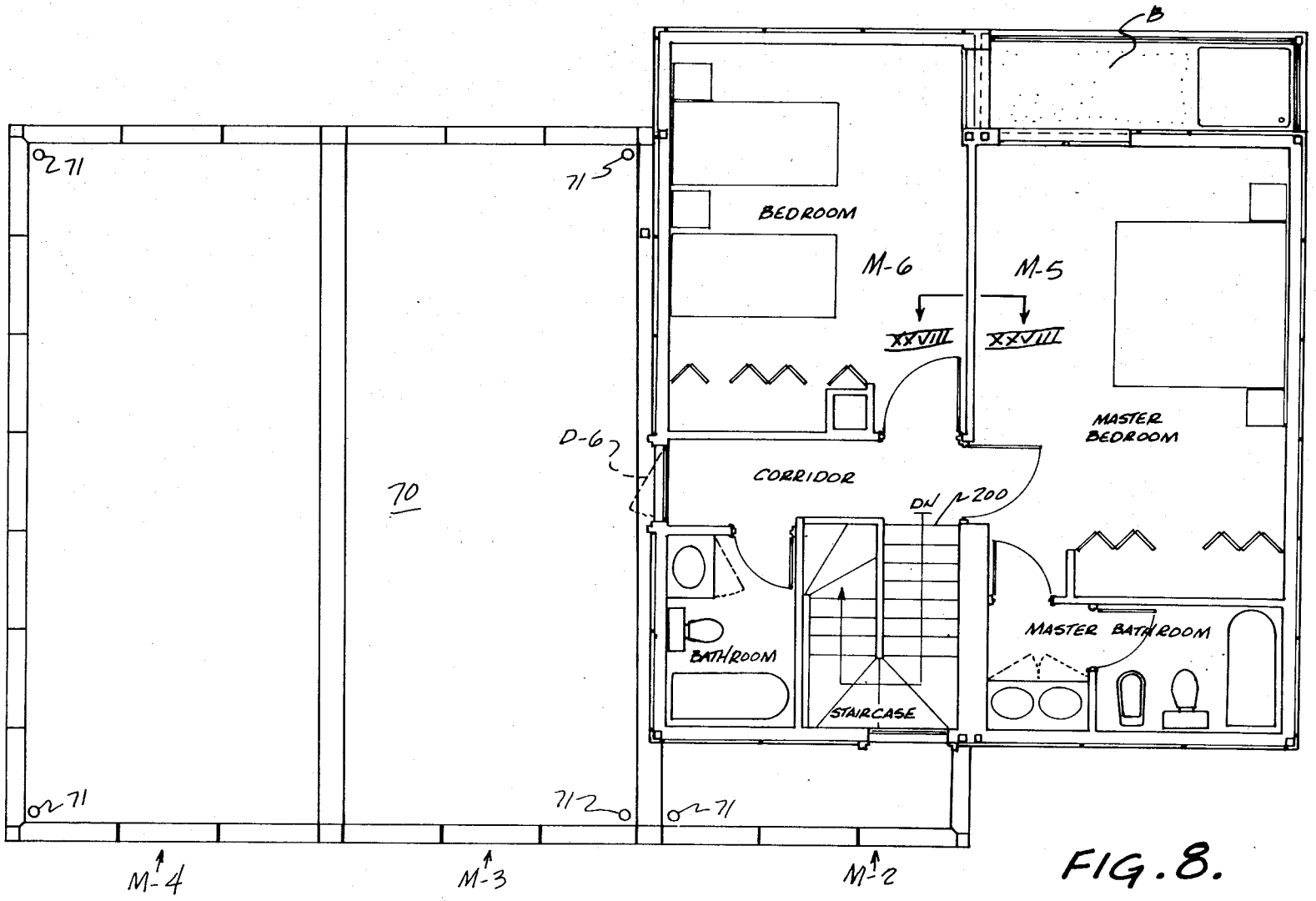
FIG. 8 is a floor plan of the second floor of the building illustrated in FIGS. 4–6.

As can be seen in FIGS. 7 and 8, a conventional layout for a dwelling is provided with no visible or protruding internal supports other than the portal frame columns and diagonal bracing, both of which are concealed within the exterior and/or interior walls therearound. The interior of the unit (FIG. 7), i.e. the first floor, could be modified in any fashion as desired within a perimeter defined by the letters A–J, for though as illustrated with various interior walls included between the modules M-1 through M-4 following the particular design scheme, the entire area within the perimeter A–J could be totally open, all without any loss of strength or stability. Furthermore, should it be desirable, for example, to extend the length of the first floor, to enlarge the salon-living area, it would only be necessary to move module M-4 outwardly and insert a further module with no exterior longitudinal walls between modules M-3 and M-4.

Looking further at FIGS. 7 and 8, one may ascertain the absence of double internal walls typical of modular constructions. Module M-3, having been designed at the factory for particular placement as shown, includes no longitudinal walls between points B and I or at the juncture with module M-4 indicated by a phantom line. End walls of module M-3 include plain panels 85 and a window panel 185 across the front end of the module (FIG. 4), and plain panels 85 and a sliding door panel 185 across the rear end of the module (FIG. 5) with the cantilever section extending outwardly beyond same providing a section of patio PA. Likewise as can be seen from FIG. 6, a short section of longitudinal wall is provided with a plain panel 85 adjacent the entrance to the house. Also as illustrated in FIGS. 4 through 8, vertical beams of the cantilever sections when exposed on patios, balconies, entrance ways and the like are covered with decorative panel members that may be of the same material as the cladding panels 85 or otherwise.

With further reference to FIGS. 7 and 9, modules M-3 and and M-4 are provided with cantilever sections 30 that define the patio PA. In FIG. 9, it can be seen that the monolithic concrete floor 50 does not extend fully along the length of lower module M, but instead extends only along the basic module and the left hand cantilever section. A lower surface 150 is then provided for the right hand cantilever section. Such lower surface 150 represents a patio of the type shown in FIG. 7 where instead of the monolithic floor 50, a suitable frame work is received in the area with thin glass reinforced concrete or other type panels secured thereto.

Modules M-5 and M-6 have a cantilever section at the rear end of the structure only, with the interior of same being laid out as shown in FIG. 8 according to conventional construction techniques. Again, interior layout of modules M-5 and M-6 could be varied as desired in similar fashion as described with respect to the modules of FIG. 7. Roof 70 of Modules M-2, M-3 and M-4 is shown beside the living quarters of modules M-5 and M-6 with a door D-6 providing access to same from module M-6. Should it become desirable, an appropriate further floor structure could be added atop roof 70 to provide a patio thereover, or alternatively, one or two additional modules could be added atop modules M-3 and M-4 to further expand the living quarters of the dwelling.

The various modules M-1 through M-6 are thus produced, for best results, according to a particular building design. Variance of placement or inclusion of walls and floors has been mentioned immediately above. As can be seen in FIGS. 7 and 8, a staircase 200 is provided in module M-2 and extends upwardly into module M-6. Staircase 200 is preferably a separately constructed metal subsystem which is secured within modules M-2 and M-6. Appropriate openings through the ceiling and roof of module M-2 and the floor of module M-6 are thus provided during fabrication of the modules, and stairwell 200 is preferably secured within module M-2 at the factory, though the subsystem for same could be separately transported to the site and installed in both modules. Either approach requires further securement and finish work on site.

Figure 26:
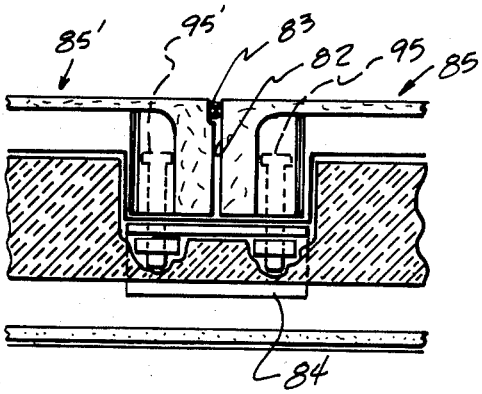
FIG. 26 is a horizontal cross sectional view of the peripheral edges of two plane cladding panels, illustrating a connection therebetween.

When two modules are placed side by side, e.g., modules M-3 and M-4, it is important that the floor, walls, etc. from one module to the other be coplanar. Accordingly, as shown in FIG. 29, during installation of the modules, a bracket 27 may be secured to an underside of trusses 24 and 24' which will maintain coplanarity of floors 50–50' thereabove. Thereafter, once a carpet or other floor covering 59 is placed thereover, the gap 57 between floors 50 and 50' becomes unnoticeable. See also FIG. 28. Likewise similar brackets may be included atop the modules if desired due to loading, tolerances or the like. While not illustrated, joints along internal side walls and ceilings may be taped and finished according to conventional techniques, or may receive a conventional polymeric plugging strip. Likewise in fabrication of the modules, it is desirable that the exterior surfaces 86 of panels 85 be coplanar. Such is achieved by the connector shown in FIG. 26 where a first panel 85 is located adjacent a second panel 85' having a joint 82 therebetween. Bolts 95, 95' from adjacent peripheral ribs 90, 90' are secured to a bracket 84 having appropriate openings therein for same. Bracket 84 thus prevents one of the panels from buckling away from planarity with the outer surface of the adjacent panel. Also as can be seen in FIG. 26, notch 90' in panel 85' resides at joint 82 with panel 85, and provides adequate space for receipt of foam and plastic materials 83 to seal joint 82 against passage of water while permitting thermal expansion and contraction of the adjacent panels 85, 85'.

As illustrated in FIG. 9, diagonal vertical bracing 17 may be needed along one or more walls of a module depending on load conditions to which the module may be subjected. Such bracing 17 does not, however, generally interfere with the overall architectural flexibility of the system. For example, in all cases bracing 17 is located within the space between the upper horizontal peripheral frame members and the lower horizontal peripheral frame members whereby same is enclosed within walls located thereat. Vertically stacked modules generally require bracing 17 in the lower module. Referring to FIG. 7, for example, lower modules M-1 and M-2 would preferably include bracing 17 which could be located along exterior walls of the composite or within interior walls X. In instances where a module requires bracing 17, yet has no longitudinal wall, the bracing could be located within a longitudinal wall of an adjacent module which would be transferred through horizontal bracing, e.g., the floor and roof from one module connected to another.

FIGS. 4–8 thus demonstrate the versatility of the modular construction system according to the present invention, and in particular demonstrate the strength of the individual modules. Further innumerable designs are compatible with the present system. In fact, though not shown, a gabled or other type roof may be applied to the modules. Likewise, virtually any style of exterior wall surface may be employed though should the exterior wall deviate from the preferred embodiments described above, certain efficiencies may be lost.

Having described the present invention in detail, it is obvious that one skilled in the art will be able to make variations and modifications thereto without departing from the scope of the invention. Accordingly, the scope of the present invention should be determined only by the claims appended hereto.

That which is claimed is:

1. A transportable building module comprising:

(a) a load bearing support system, said support system comprising a pair of portal frames, said portal frames including two spaced apart vertical columns having upper and lower transverse beam secured therebetween, inwardly from upper and lower ends of same respectively, two upper longitudinally extending beams secured to vertical columns of opposite portal frames adjacent upper ends of same, a plurality of spaced apart roof purlins secured between said upper longitudinal beams below upper surfaces of same and at different locations defining a predetermined slope thereacross, two longitudinal open web trusses secured to said vertical columns of said portal frames, inwardly from lower ends of same, a plurality of spaced apart tubular floor purlins secured between said open web trusses, upper surfaces of said floor purlins, open web trusses and lower horizontal beams of said portal frames generally defining a floor area of said module and being substantially coplanar, and a monolithic, reinforced concrete floor produced in situ over said floor area;

(b) a roof structure secured to said roof purlins, said roof structure comprising a plurality of panels secured to said roof purlins and a waterproof membrane secured over said panels, said roof structure following said predetermined slope defined by said roof purlins;

(c) a plurality of exterior panels secured to said support system along all intended exterior sides of same and to adjacent panels, said panels extending from below said open web trusses above said upper longitudinal beams and defining a flange thereat extending inwardly of said beams, said panel flanges defining a parapet therealong;

(d) a water vapor barrier material received between said exterior panels and said support system and being secured thereat, said barrier material being spaced apart from at least a portion of an inside surface of said panels along the length of same and defining a ventilating passageway therealong;

(e) a plurality of brackets secured to said support system adjacent an upper end of same, said brackets including an inwardly extending flexible portion;

(f) a ceiling grid located below said roof purlins and being secured at peripheral edges of same to said flexible portions of said brackets;

(g) at least one interior wall structure located within said support system, said wall structure comprising lower support means rigidly secured to said floor, upper support means united with said ceiling grid, vertical wall studs secured between said upper and lower support means and interior wall panels secured to said studs so that during transit of said module, said flexible portion of said brackets will dissipate stresses induced to minimize damage to said at least one interior wall.

2. A transportable building module comprising:

(a) a load bearing support system, said system comprising two pairs of spaced apart vertical columns, each column representing one corner of the system, the columns of each pair having transverse horizontal beams secured therebetween adjacent the upper and lower ends of same, opposite columns of each pair having longitudinal horizontal beams secured therebetween adjacent upper ends of same, said longitudinal horizontal beams having a plurality of spaced apart roof purlins secured therebetween, and a reinforced monolithic concrete floor secured between said pairs of columns adjacent a lower end of same with said columns extending therebeneath;

(b) a roof structure secured to said support system;

(c) a plurality of exterior panels secured to said support system around the portion of the periphery of same that is intended as an exterior surface, said panels having reinforcing ribs extending longitudinally thereof and defining an inturned flange portion at a top of same, said flange portion extending above and inwardly of said upper horizontal beams;

(d) a flexible vapor barrier received between said panels and said support system and secured to said support system, at least certain of said reinforcing ribs of said panels engaging said vapor barrier, said panels and said vapor barrier defining a ventilating passageway completely along the length of said panels; and (e) an interior wall structure located inwardly of said support system, said interior wall structure comprising a stud wall having a plurality of interior panels secured thereto said stud wall being rigidly secured at a bottom end to said floor and flexibly secured to said support system at an upper end thereof.

3. A transportable building module as defined in claim 2 wherein said monolithic concrete floor comprises a pair of open web trusses secured between said vertical columns, a plurality of spaced apart tubular beams secured between said trusses, a plurality of shear connectors secured to said trusses and said tubular beams and extending upwardly therefrom, a reinforcing mesh received atop said trusses and beams with said shear connectors passing therethrough and a monolithic concrete slab produced in situ thereabout, a lower surface of said slab being generally coterminous with an upper surface of said beams and surrounding said reinforcing mesh and said shear connectors.

4. A transportable building module as defined in claim 2 wherein said roof structure comprises a plurality of panels secured to each other and secured to said roof purlins and said upper horizontal beams of said support system and a waterproof membrane secured over said panels, outer edges of said membrane extending about said upper beams and downwardly beneath said panels.

5. A transportable building as defined in claim 2 wherein a plurality of brackets are secured to upper horizontal elements of said support system, said brackets having an unsecured flexible leg extending inwardly of said support system, and wherein said stud wall comprises lower stud runners secured to said floor and upper stud runners associated with said flexible legs with studs received therebetween at predetermined intervals, said studs having interior wall panels secured thereto.

6. A transportable building module as defined in claim 5 wherein elongated members are secured to said flexible legs and furring channel members are secured to said elongated members and are united to define a ceiling grid and wherein said upper stud runners are secured to said ceiling grid.

7. A transportable building module comprising:

(a) a load bearing support system, said support system comprising a pair of spaced apart portal frames, said portal frames including two spaced apart vertical columns having upper and lower transverse tubular beams secured therebetween, inwardly from upper and lower ends of same respectively, upper longitudinally extending elements secured to vertical columns of opposite portal frames, adjacent upper ends of same, a plurality of spaced apart transversely extending roof purlins secured between said upper longitudinal elements, below upper surfaces of same and at different locations defining a predetermined slope thereacross, longitudinal open web trusses secured to said vertical columns of said portal frames, inwardly from lower ends of same and a plurality of spaced apart floor purlins secured to said open web trusses, upper surfaces of said trusses and said floor purlins being substantially coplanar and said floor purlins being located adequately above a lower end of said vertical columns to define a crawl space therebeneath;

(b) a reinforced monolithic in situ produced concrete floor about said open web trusses and said floor purlins;

(c) a roof structure secured to an upper portion of said support system;

(d) a plurality of exterior wall elements secured to said support system and to adjacent wall elements around at least a portion of the periphery of same, said exterior wall elements totally concealing said support system from the exterior; and (e) at least one interior wall structure located inwardly of said support system, said at least one interior wall structure being rigidly secured at a lower end to said concrete floor and flexibly secured to said support system at an upper end thereof.

8. A transportable building module as defined in claim 7 wherein a cantilever frame section is secured to vertical columns of at least one of said portal frames, said cantilever section comprising opposite upper and lower longitudinal elements secured at their outer ends to a vertical beam and with horizontal transverse beams secured between the upper and lower longitudinal elements at the outer ends of same, a lower surface of the upper longitudinal elements being generally coplanar with a lower surface of the longitudinally extending elements of the load bearing support system thereat and upper surfaces of the lower longitudinal elements being generally coplanar with upper surfaces of said lower horizontal longitudinally extending elements of the load bearing support system.

9. A building structure comprising a plurality of horizontally adjacent modules as defined in claim 1, each said module being independently supported on a foundation means by said vertical columns of the support system for same and associated with a next adjacent module adequate to achieve coplanarity of adjacent interior planar surfaces where desired, each module having the support system for same totally enclosed within walls of the structure whereby no support element is visible.

10. A transportable building module as defined in claim 7 wherein said roof structure comprises a plurality of planar panels secured to each other and to said roof purlins and a flexible waterproof membrane secured over said panels.

11. A transportable building module as defined in claim 10 wherein said exterior wall elements are cladding panels, said panels extending from a location below said floor upwardly and defining an inturned flange at an upper end of same, said flange extending above and inwardly of said support system.

12. A transportable building module as defined in claim 7 wherein a vapor barrier material is secured to an outside of said support system, inside of said cladding panels, and wherein at least a portion of said cladding panel is spacially separate from said vapor barrier along the full length of said panel, whereby a ventilating space is provided along the height of exterior sides of said module.

13. A transportable building module as defined in claim 12 wherein said cladding panels and said vapor barrier are secured to said support system at upper and lower portions of same only, and wherein said panels are provided with inwardly protruding ribs along opposite edges of same, said ribs pressing against said vapor barrier material intermediate the securement points for same to hold said vapor barrier material taut along its length.

14. A transportable building module as defined in claim 7 wherein a plurality of brackets are secured to an upper portion of said support system, said brackets including a flexible portion, and wherein an upper portion of said interior wall structure is united with said flexible portion of said brackets.

15. A transportable building module as defined in claim 13 wherein further a plurality of furring strips define a ceiling grid and wherein peripheral edges of said ceiling grid are united with said flexible portion of said brackets, said upper portion of said interior wall structure being secured to said ceiling grid.

16. A transportable builiding module as defined in claim 14 wherein said interior wall structure comprises a lower wall support rigidly secured to said floor, an upper wall support secured to said ceiling grid, vertical wall studs secured between said wall supports and interior panels secured to said wall studs.

17. A transportable building module as defined in claim 16 wherein said interior panels are gypsum board panels, and a fabric is adhesively secured across said panels and the joints therebetween.

18. A transportable building module as defined in claim 16 wherein said panels are gypsum board and a flexible polymeric film is secured across said panels and the joints therebetween.

19. A building structure as defined in claim 9 wherein further at least one further module is stacked atop at least one of said horizontally adjacent modules, said vertical columns of said top module being associated with vertical columns of said bottom module.

20. A building structure as defined in claim 19 wherein said vertically stacked modules have at least one cantilever section secured to at least one end of said respective support systems; the space between a lower level of the cantilever section of said top module and the roof of the bottom module defining a crawl space along the width of the module.

21. A building structure as defined in claim 9 wherein exterior walls of said modules around the perimeter of the structure are cladding panels, said panels having an inturned flange at an upper portion of same that extends above and inwardly of said roof, said inturned flanges cooperating to define a parapet around said roof.

22. A building structure as defined in claim 9 wherein a cantilever section is secured to at least one end of the support structure of at least one module.

23. A building structure as defined in claim 22 wherein said cantilever section defines an extension of the interior volume of the module.

24. A building structure as defined in claim 22 wherein said cantilever section defines an exterior portion of said structure.

* * * * *